US005833227A

United States Patent [19]

Choho et al.

[11] Patent Number: 5,833,227

[45] Date of Patent: Nov. 10, 1998

[54] AUTOMATIC DOCUMENT FEEDER

[75] Inventors: Satoshi Choho, Kawasaki; Shunji Sato, Tokyo, both of Japan

[73] Assignee: Canon Kabushiki Kaisha, Tokyo, Japan

[21] Appl. No.: 846,498

[22] Filed: Apr. 28, 1997

Related U.S. Application Data

[63] Continuation of Ser. No. 612,078, Mar. 7, 1996, abandoned, which is a continuation of Ser. No. 232,435, Apr. 21, 1994, abandoned, which is a continuation of Ser. No. 909,214, Jul. 6, 1992, abandoned.

[30] Foreign Application Priority Data

Jul. 8, 1991 [JP] Japan ..... 3-167025

[51] Int. Cl.[6] ..... B65H 5/00

[52] U.S. Cl. ..... 271/10; 271/265

[58] Field of Search ..... 271/4, 6, 10, 265

[56] References Cited

U.S. PATENT DOCUMENTS

| | | | |
|---|---|---|---|
| 3,556,512 | 1/1971 | Fackler | 271/4 |
| 4,896,876 | 1/1990 | Yamada et al. | 271/265 |
| 4,940,225 | 7/1990 | Sato et al. | 271/296 |
| 4,974,827 | 12/1990 | Arai et al. | 271/265 |
| 5,112,038 | 5/1992 | Dunaway | 271/10 |
| 5,118,089 | 6/1992 | Yamada et al. | 271/265 X |
| 5,119,145 | 6/1992 | Honjo et al. | 271/265 X |
| 5,197,723 | 3/1993 | Yamada et al. | 271/4 |

FOREIGN PATENT DOCUMENTS

| | | | |
|---|---|---|---|
| 0056337 | 2/1990 | Japan | 271/10 |
| 3061239 | 3/1991 | Japan | 271/10 |

*Primary Examiner*—H. Grant Skaggs
*Assistant Examiner*—Khoi H. Tran
*Attorney, Agent, or Firm*—Fitzpatrick, Cella, Harper & Scinto

[57] ABSTRACT

An automatic document feeder provided with a pre-feed function, in which during reading an originals, a succeeding original is fed to an entry of a reading station and keep it there includes an original stacking tray for stacking originals; a separator for separating a single original from the stacked originals on the stacking tray; a driver for driving the separator; a feeder for feeding the original separated by the separator; a second driver for driving the feeder; a conveyer for conveying the original fed by the feeder; a third driver for driving the conveyer; and a controller, provided with detector disposed downstream of the feeder, for stopping the original adjacent an inlet of the conveyer.

25 Claims, 19 Drawing Sheets

AUTOMATIC DOCUMENT FEEDER

This application is a continuation of application Ser. No. 08/612,078, filed Mar. 7, 1996, now abandoned, which is a continuation of application Ser. No. 08/232,435 filed Apr. 21, 1994, now abandoned, which is a continuation of application Ser. No. 07/909,214 filed Jul. 6, 1992, now abandoned.

FIELD OF THE INVENTION AND RELATED ART

The present invention relates to an automatic document feeder, in particular, an automatic document feeder provided with, for example, a pre-feeding function to convey a succeeding original sheet to the entry point of a platen while a preceding document is read.

Referring first to FIG. 1, in the conventional automatic document feeder, an auxiliary roller 3, a feed roller 8, and a separating belt 10 are rotated and controlled by a motor 47; a register roller 14 and a conveyer belt 20 are rotated and controlled by a motor 45; and a roller 15 and a discharge roller 32 are rotated by a motor 46. The gear train of the motor 45 and the gear train of the motor 47 are connected through a one-way clutch. The rotation of the gear train of the motor 47 is slower than that of the motor 45.

In FIG. 1, a single original sheet is separated from the set of original documents by the coordination between the slow forward rotation of the rollers 3 and 8 which are rotated by the motor 47 and the reverse rotation of the belt 10, and is abutted against the register roller 14 which is standing still. After the presence of the original is detected by a sensor 13 and a loop or bulge is formed on the original sheet, the motor 47 is stopped. The attitude of the original is corrected by this abutment.

Then, the rotation of the motors 45 and 47 is started, whereby the register roller 14 and the feed roller 8 are rotated to convey the original. At this time, the gear train of the motor 47 is made to rotate faster by the gear train of the motor 45, due to the function of the clutch, and as a result, the roller 14 and the roller 8 rotate at the same speed. Therefore, the original sheet is conveyed while maintaining the bulge.

After a predetermined number of seconds from the time when the register roller 14 begins to rotate, both of the motors 45 and 47 are stopped, positioning the leading end of the original sheet at the upstream entry end of the belt 20. This completes the operation to pre-feed the original.

Then, as the preceding original is discharged from the platen, the motor 45 rotates, giving forward rotation to the register roller 14 and the belt 20 to send the current original onto the platen surface. After a predetermined number of seconds from the time when the trailing end of the original passes the sensor 13, the motor 45 is stopped to position the original at a predetermined location on the platen.

According to the above mentioned arrangement, the load can be small since the roller 8 and the register roller 14 rotate at the same velocity while the original is pre-fed by the resistor roller 14, preventing the generation of tension on the original.

In addition, since the register roller 14 and the belt roller 20 are rotated by the same motor 45, and also, since the counting is initiated by the sensor 13 placed on the upstream side of the register roller 14, during the positioning of the original on the platen, the positioning can be accurately carried out.

However, according to the above mentioned example of the prior arrangement, since the clutch must be provided between the motor 45 and the motor 47, the structure tends to become proportionally more complicated.

Also, since the pre-feed point is determined based on the counting initiated at the moment when the register roller 14 begins to rotate, it is difficult to control the pre-feed operation because of the slip between the rollers, although it is small. Therefore, the pre-feed point is set up at a point on the slightly upstream side of the entry end of the belt 20 for the sake of a safety margin. Because of this setup, it takes a longer time to convey the original sheet from the pre-feed point to the predetermined location on the platen, interfering with the effort to accomplish a satisfactory speed.

SUMMARY OF THE INVENTION

Accordingly, it is a principal object of the present invention to provide an automatic document feeder which is capable of a high speed operation, and is simple in structure.

According to an aspect of the present invention which is made to accomplish the above objective, the clutch is eliminated, and also, the sensor is mounted on the downstream side of the register roller.

In addition, according to another aspect of the present invention, the register roller also works as one of a pair of document inverting rollers.

According to the aspects of the present invention, the structure becomes simple due to the elimination of the clutch. Although the elimination of the clutch necessitates the provision of a new sensor to take its place, the structure using the sensor is several times simpler than that using the clutch, and also, has a cost advantage.

Further, since the sensor for the pre-feed operation of the original is mounted on the downstream side of the register roller, the positioning can be accurately carried out. Therefore, the pre-feed point can be set up at a point barely away from the upstream side of the belt, whereby it takes less time from the time when the original is fed until the time when it is positioned on the platen.

Further, the use of the register rollers as the inverting roller makes the structure simpler.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
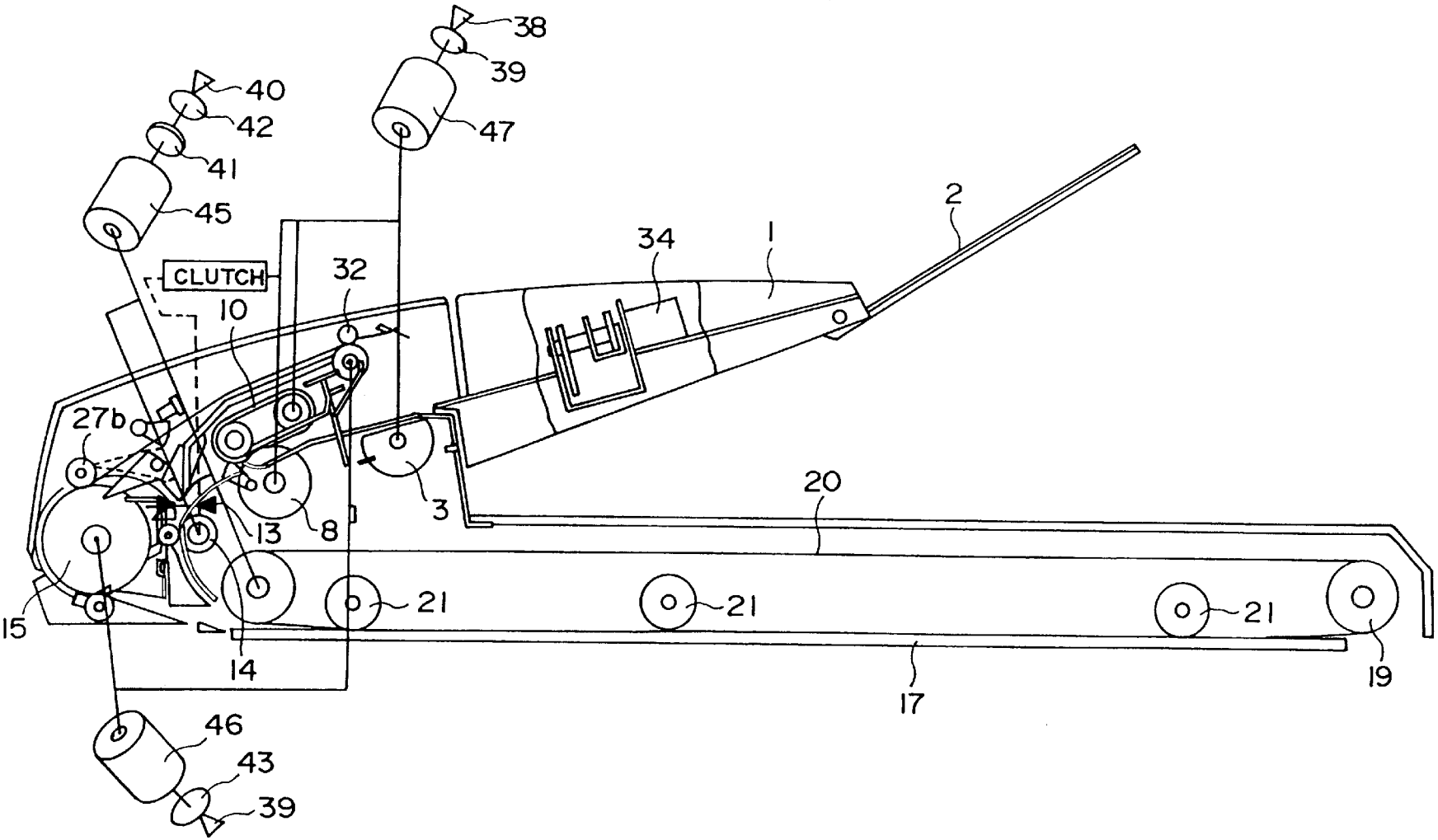
FIG. 1 PRIOR ART
FIG. 1 is a front view of an example using a prior art arrangement.

Hereinafter, preferred embodiments of the present invention are described by referring to the drawings.

Figure 2:
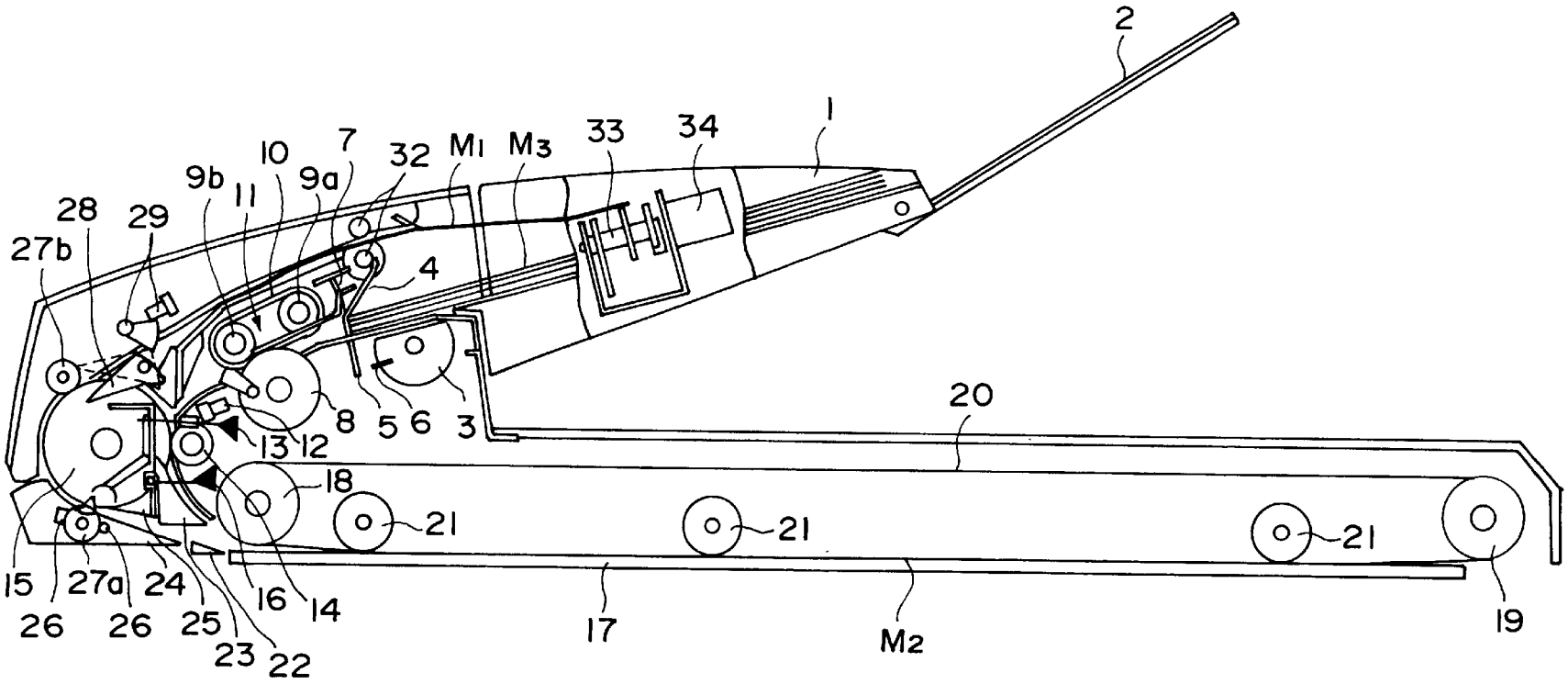
FIG. 2 is a front view of an apparatus according to a preferred embodiment of the present invention.

In FIG. 2, reference numeral 1 designates an original sheets tacking tray, 2 an auxiliary for stacking long size original sheets, and 3 a crescent or half-moon shaped roller; a single original sheet is separated from a set of original sheets M by this half-moon roller 3, and is fed by the coordination between this half-moon roller 3 and weight 4.

Reference numeral 5 designates a stopper for the leading end of the loaded set of original sheets M, and a sensor 6 detects the set of original sheets M. A separation control plate 7 functions to control or guide the set of original sheets M entering a separation station. The separation station 11 comprises rollers 9*a* and 9*b*, a separation belt to bridge the distance between the rollers 9*a* and 9*b*, and a feed roller 8, and separates, one by one, a single original sheet M from the bottom side of the set of original sheets M. A separation sensor 12 functions to quickly detects a paper jam after the separation. A sensor 13 is placed on the upstream side of a register roller and detects the leading end of the original sheet M. This detection initiates the operations such as abutting the leading end of the original sheet to the nipping section formed by the register roller 14 and the conveying roller 15, or synchronizing the loop formation, whereby the original sheet M is further conveyed. When the leading end of the original sheet M is detected by a register sensor 16, the conveying action is ceased, and then, when the trailing end of the original sheet M is detected by the register sensor 16 during the succeeding conveying action, the original sheet M is controlled to be positioned on a platen 17; the original sheet is conveyed over the platen by a full width belt 20 extended between a driving roller 18 and a follower roller 19, and pressure rollers 21 which impact pressure from behind the belt 20. A jump plate 22 guides the discharged original sheet M from the platen 17 to the sheet conveying passageway. This discharged original sheet is further guided by an interim guide 23, a lower guide 24, inverting stay 25, and the like. The interim guide's upper surface also defining an inlet to belt 20. Reference numeral 26 is an inversion sensor, and 27 an inverting roller, which is pressed against conveying roller 15. A flapper 28 functions to switch the passageway of the original sheet, that is, to guide the original sheet either to a discharge roller 32 or to the register roller 14. A sheet discharge sensor 29 controls the sheet discharging timing when the original sheet M is discharged by the discharge roller 32. Further, at the rear end of the tray 1, a lever 33 for detecting the processing of the last original sheet (hereinafter, called recycle lever) is provided, which is rotated by the driving force from a recycle motor 34.

Figure 3:
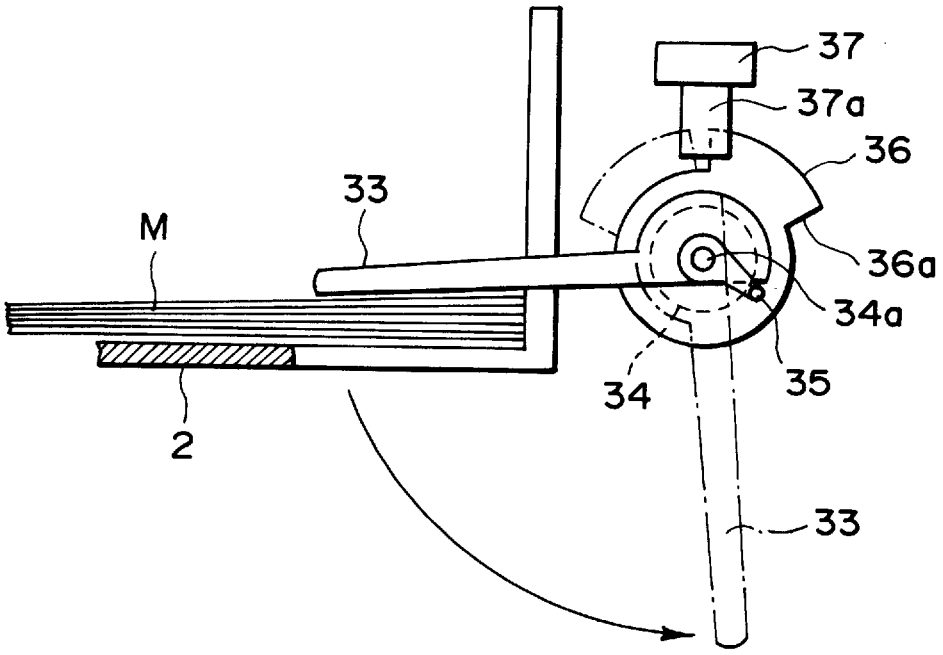
FIG. 3 illustrates the operation of a recycle lever.

Referring to FIG. 3, the recycle lever 33 will be described.

The lever 33 is rotatably mounted on a shaft 34*a* of the recycle motor 34, and pin 35, which rotates this lever 33, is fixed on the shaft 34*a*. Also, a flag 36 is supported so as to be rotatable with the lever 33. Further, an optical sensor 37 for detecting the location of the flag 36 is provided adjacent to the passage of this flag 36.

When an unshown copying process start key is turned on, the recycle motor 34 starts its rotation to rotate the pin 35, and then, the lever 33 rotated by the pin 35 presses down on the uppermost sheet of the set of original sheets M.

When the lever 33 falls down to the position outlined by the broken line due to its own weight after the last sheet of the set of original sheets M is fed, the sensor 37 detects the trailing end 36*a* of the flag 36 which is displaced by the movement of the lever 33, whereby it is determined that the current original sheet is the last sheet from the set of original sheets M, and also, one cycle of processing the set of original sheets M is completed.

Figure 4:
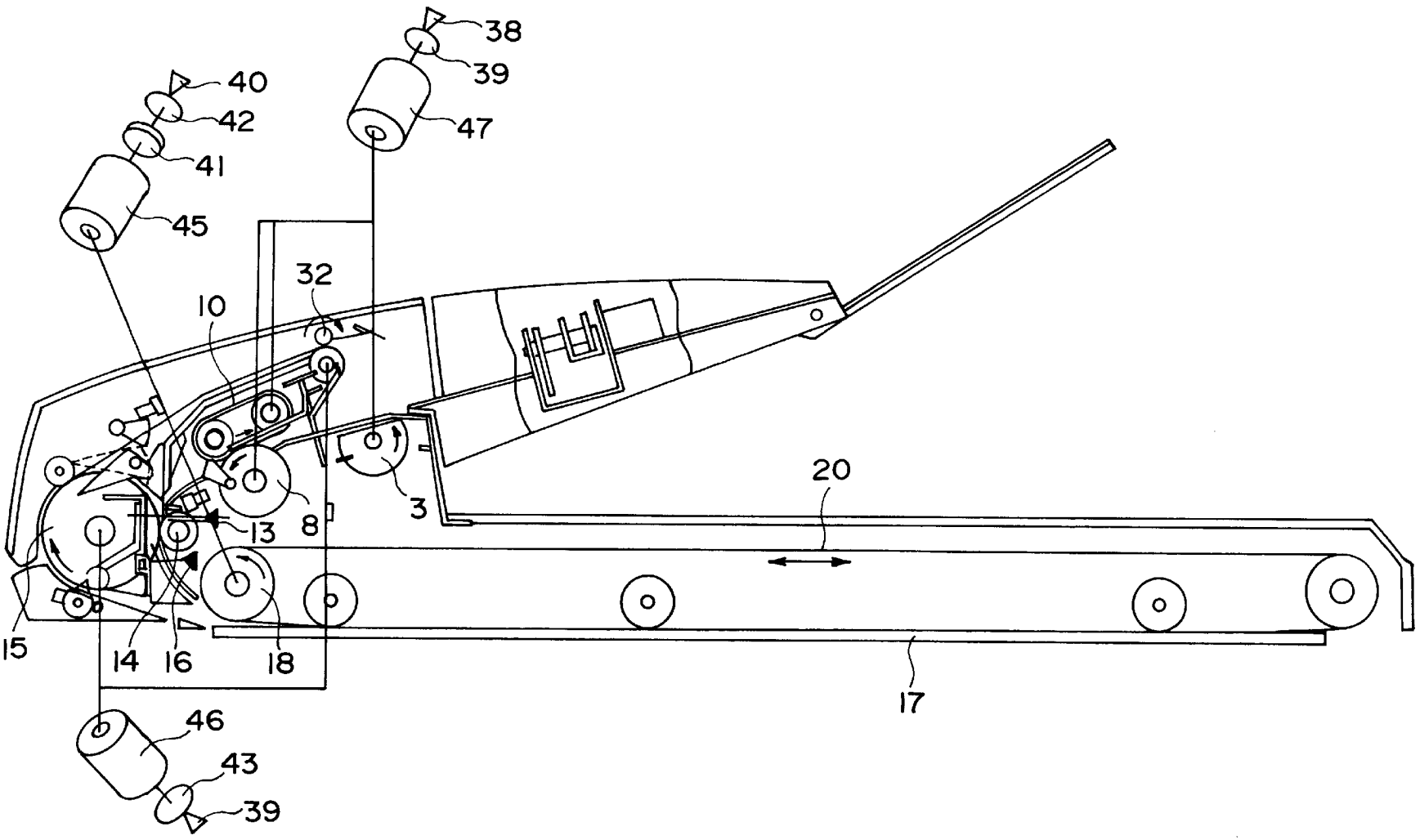
FIG. 4 illustrates the driving systems of the apparatus.

FIG. 4 shows the driving systems of the preferred embodiment of the present invention, wherein a separation station driving motor 47 rotates the half-moon roller 3, the separating roller 8, and a pair of rollers 9*a* and 9*b*, which in turn rotate the separating belt in the direction indicated by the arrow. The conveying motor 46 rotates the conveying roller 15 and a pair of the discharge rollers 32 in the direction indicated by the arrow. The belt driving motor 45 selectively rotates the driving roller 18, forward or backward, which in turn rotates the full width belt 20, forward or backward.

Next, the operation of the preferred embodiment of the present embodiment is briefly described.

In the case a simplex copy is made from a simplex original sheet

A single original sheet separated one by one by the function of the rollers 3 and 8, and the separating belt 10 (the original sheet faces upward in the tray 1) is temporarily stopped at the register roller for its attitude to be corrected, and then,-is conveyed to the reading location on the platen 17 by the register roller 14 and the belt 20 (the original sheet faces downward, this time). After the optical system of the copying machine main assembly (described later) scans the original sheet to read it (to be copied on one of the surfaces of a transfer material), the original sheet is discharged leftward from the surface of the platen 17 by the reverse rotation (rightward rotation) of the belt 20.

The discharged original sheet is guided to a platen roller 15 by guides 24 and 25, is inverted by the rightward rotation of this platen roller 15, and is guided to the roller 32 by the flapper 28. The returned original sheet is stacked in the tray 1, restoring its initial orientation.

In the case a duplex copy is obtained from a duplex original sheet

The original sheet positioned on the platen through the same procedure as the above is not immediately read, and instead, is discharged to the side of platen roller 15 by the rightward rotation of the belt 20. At this time, the flapper 28 holds the position outlined by the broken line, and therefore, the original sheet is guided to the register roller 14 by the rightward rotation of the platen roller 15, and subsequently, is again guided to the surface of the platen by the forward rotation of the register roller 14 and the belt 20. At this time, the original sheet has the same orientation as its initial orientation in the tray 1, in other words, the fourth page faces the platen surface if the set of original sheet consists of four pages. This fourth page is read by the optical system (is copied on one of the surface of the transfer material).

After reading, this original sheet is discharged leftward by the reverse rotation of the belt 20, and is again conveyed to the entrance to the belt 20, along the platen roller 15 and register roller 14, in the same manner as the above. Then, this original sheet is conveyed to the surface of the platen by the forward rotation of the belt 20. At this time, the third page faces the platen surface. After it is read by the optical system (transferred on the back side of the above mentioned transfer material), it is discharged leftward by the reverse rotation of the belt 20, and is returned through the discharge roller 32 to the tray 1 where it is stacked, regaining the initial orientation (third page faces upward).

On the other hand, the transfer material, on both surfaces of which images have been formed, is stacked in the discharge tray, with its third page facing upward.

Figure 5:
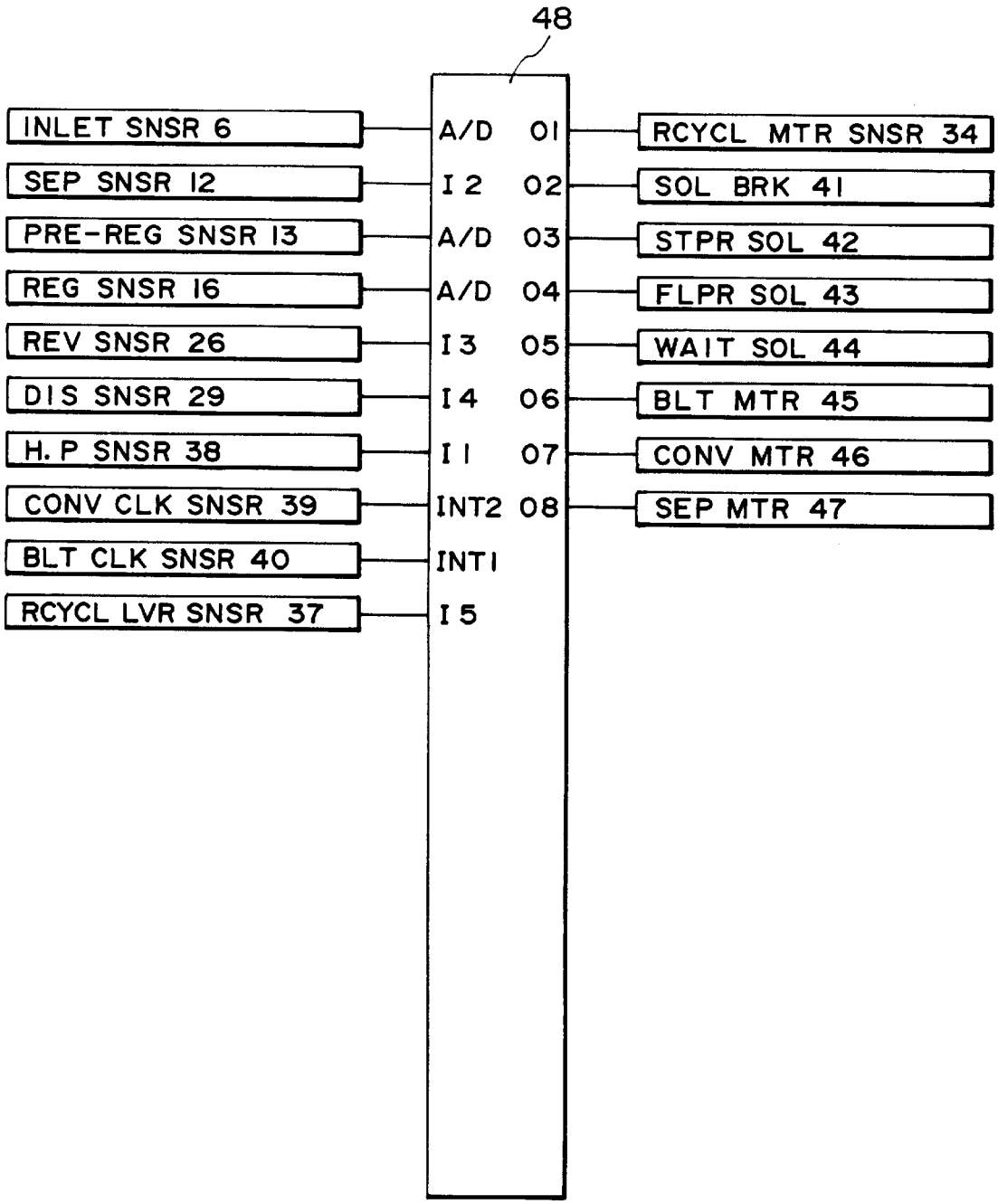
FIG. 5 illustrates the operational control.

FIG. 5 is a block diagram showing the control system of the preferred embodiment of the present invention. This control system is built around a well-known single chip microcomputer 48 (CPU) containing ROMs, RAMs and the likes. To an input port 11, a half-moon roller home position sensor 38 is connected. The half-moon roller position sensor 38 coordinates with a clock disk 39, which is mounted on the shaft of the separation station driving motor 47, to detect whether or not the half-moon roller is at the home position, in other words, whether or not the half-moon roller is projecting into the conveying passageway. To input ports 12 to 15, a separation sensor 12, an inversion sensor 26, sheet discharge sensor 29, and recycle lever sensor 37 are connected, respectively. To A/D channels A/D 1 to A/D 3, an entrance original sensor 6, pre-register sensor 13, and a register sensor 16 are connected, respectively. Further, a clock disk 42 is mounted on the shaft of the belt motor and is mated with the belt clock sensor 40 to detect the motor revolutions. The signal from this belt clock sensor is inputted to an interruption terminal INT1. A clock disk 43 is mounted on the shaft of the conveying motor and is mated with a conveying motor clock sensor 39 to detect the motor revolutions. The signal from this conveyer motor clock sensor 39 is inputted to an interruption terminal INT2. These signals are used as the reference clock for the amount of the sheet conveyance, and are counted by a counter within the CPU. To output ports 01 to 08, recycle motor 34 for driving the recycle lever 33, an electromagnetic brake 41 for stopping or braking the rotation of the belt motor 45 mounted on the belt motor shaft, a stopper solenoid 43 for opening or closing the conveyance passageway for the original sheet, a flapper solenoid 43 for driving the flapper 28 which controls the original sheet to be inverted or discharged, a weight solenoid 44 for driving the weight 4, the belt motor 45, the conveying motor 46, and separating motor 47 are connected, respectively.

Inverting mode

Figure 6:
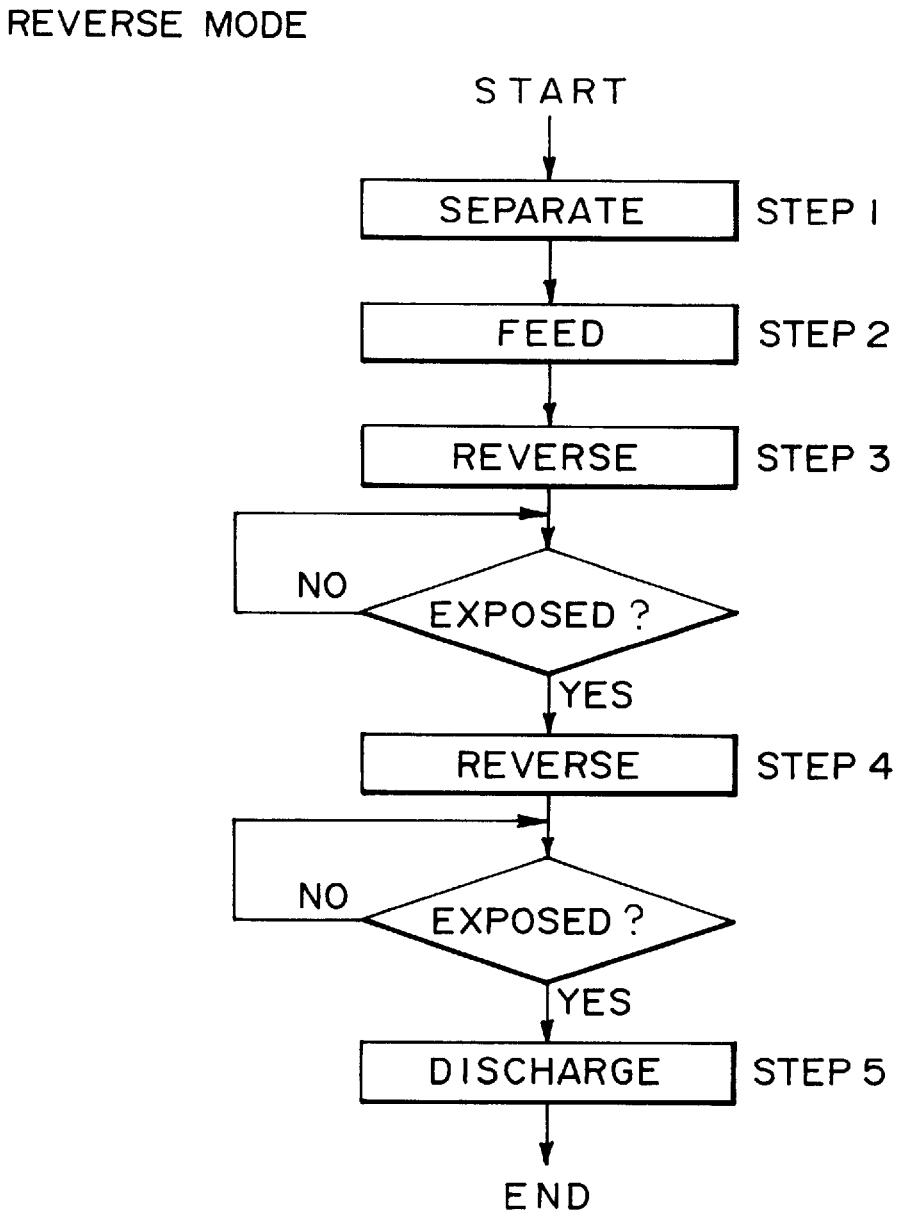
FIG. 6 is a flow chart of sequential operations in the reverse mode.

In the above mentioned structure, the inverting mode processing is described by referring to FIG. 6. To begin with, in STEP 1, the bottommost sheet of the original sheets in the original sheet stacking tray 1 is separated by the separating process; in STEP 2, the original sheet separated in STEP 1 is conveyed to the surface of the platen 17 by the feeding process (at this time, the original sheet is not read); in STEP 3, the original sheet which is inverted by the inverting process is again fed and conveyed onto the surface of the platen 17; in STEP 4, which comes after the completion of the first exposing process, the original sheet is again inverted and is placed on the platen surface for the second exposure of the back side; and in STEP 5, which comes after the completion of the second exposure, the original sheet is discharged to take the uppermost place of the set of the original sheet in the original sheet stacking tray 1 by the discharging process.

Figure 7:
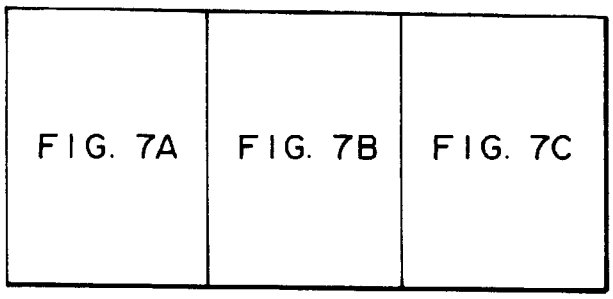
FIG. 7 includes FIGS. 7A through 7C, which show flow charts of the sequential operations of the separating process.

Separating process The separating process in STEP 1 in FIG. 6 is described by referring to the flow chart in FIG. 7.

In STEP 6-1, if the stopper 5 is withdrawn, STEP 6-6 is followed. Otherwise, STEP 6-2 is followed, wherein an original sheet M is separated from the stacked original sheets M. In STEP 6-3, the driving force is stopped for a predetermined length of time to let the above mentioned separated original sheet settle down. In STEP 6-4, the stopper solenoid 42 is driven, whereby the leading end of the stopper 5 is withdrawn in the arrow direction in FIG. 2 to open the original sheet conveyance passageway. In STEP 6-5, the separating motor is controlled to keep a predetermined velocity in order to make it easier for the bottommost original sheet to be conveyed to the nipping section which is formed between the separating roller 8 and separating belt 10, and when this bottommost original sheet is detected by the separation sensor 12 during this conveying operation, STEP 6-16 is followed.

If there is no detection (if the original sheet is not separated), STEP 6-6 is followed, wherein the velocity control of the separating motor is ceased to allow the full velocity rotation of the separating motor, and simultaneously, in STEP 6-7, it is detected by the half-moon roller home position sensor 38 whether or not the half-moon roller 3 is projecting into the original sheet conveyance passageway, in other words, whether or not the half-moon roller 3 is at the home position. If the half-moon roller 3 is not at the home position, STEP 6-9 is followed, and if it is at the home position, the process is continuously followed. In STEP 6-8, the separating motor is rotated for a duration which is just enough so as for the half-moon roller to project sufficiently into the conveyance passageway, and if the sensor 12 detects the original sheet during this action, STEP 6-16 is followed.

In STEP 6-9, the original sheet is conveyed by the coordination between the weight 4, which is driven by the weight solenoid to improve the conveying efficiency, and the half-moon roller 3, and when the sensor 12 detects the original sheet, STEP 6-15 is followed.

If the original sheet is not detected after an elapse of a predetermined length of time, the weight solenoid 44 is turned off in STEP 6-10. In STEP 6-11, if the sensor 12 detects the original sheet while the half-moon roller home position sensor 38 is waiting for the half-moon roller 3 to come to the home position, STEP 6-16 is followed.

In STEP 6-12, if the sensor 12 detects the original sheet while the separating motor is being rotated for a duration which is just enough to make the half-moon roller project sufficiently into the conveyance passageway, STEP 6-16 is followed.

In STEP 6-13, the weight solenoid 44 is turned on again, and if the sensor 12 detects the original sheet which is conveyed by the coordination between the weight roller 4 and the half-moon roller 3, STEP 6-15 is followed.

After an elapse of a predetermined length of time, the weight solenoid is turned off in STEP 6-14, wherein, if the sensor 12 does not detect the original sheet after an elapse of a predetermined length of time while the separating process is continued, the separating process is discontinued.

In STEP 6-15, the weight solenoid is turned off, and in STEP 6-16, the original sheet is conveyed for a predetermined length of time.

In STEP 6-17, if the selected mode is the high speed mode which carries out the discharge process while the separating process is being carried out, the separating motor is turned off, and the current original sheet M2 remains in the standby condition while the discharging process is completed for the preceding original sheet M1, which is being conveyed ahead of the current original sheet (waiting for the rollers 15 and 14 to stop). After the completion of the discharging process, the separating motor 47 is turned on in STEP 6-18, whereby the feeding of the original sheet M3 is started, and if the original sheet M3 is detected by the sensor 13 in STEP 6-19, it is conveyed for a predetermined length of time in STEP 6-20. Then, the leading end of the original sheet is abutted against the nipping section formed between the conveying roller 15 and the register roller 14, which are standing still; the looping occurs; and the separating motor 47 is stopped. Then, after a wait while the formed loop becomes stabilized, the attitude of the original sheet is corrected.

In STEP 6-21, the conveying motor 46 is controlled to hold a predetermined velocity to reduce the noise during the dissolution of the loop while the original is being conveyed, and to eliminate the variances in the conveying distances due to the inertia when the motor is stopped, and at the same time, the separating motor 47 is rotated.

When the sensor 16 detects the leading end of the original sheet M3 in STEP 6-22, the original sheet is conveyed in proportion to a predetermined number of clock counts by the interruption from the conveyance clock sensor 39, and the conveying motor 46 is stopped, ending the separating process in STEP 6-23 (the leading end of the original sheet M3 is conveyed close to the entry end of the belt 20). Further, the separating motor 47 which is turned on in STEP 6-21 is turned off by the half-moon roller home position sensor so that the half-moon roller is stopped at the home position, or is turned off at the completion of the separating process.

Then, the original sheet M2 is conveyed leftward by the reverse rotation of the belt 20, and when its leading end is fed into the nipping section formed between the rollers 15 and 27*a* (after an elapse of a predetermined number of clock counts from the time of the detection by the sensor 26), the rollers 15 and 14 are rotated to convey the original sheet M2, and simultaneously, the original sheet M3 is conveyed toward the belt 20 (refer to the following description of the sheet feeding process). The rotation of the belt 20 is switched to the forward rotation before the above mentioned last action.

Figure 8:
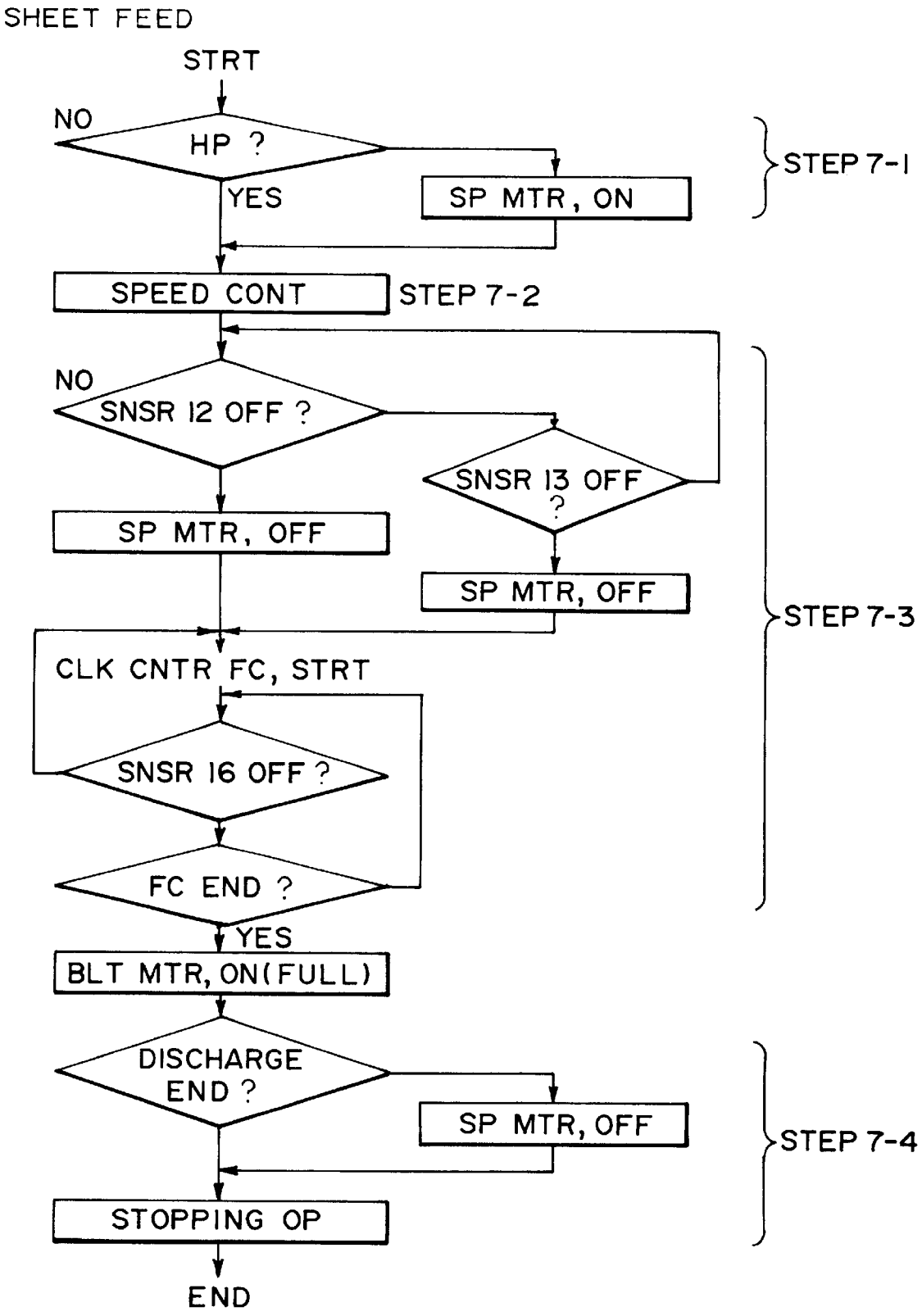
FIG. 8 is a flow chart of the sequential operations of the feeding process.
Figure 9A:
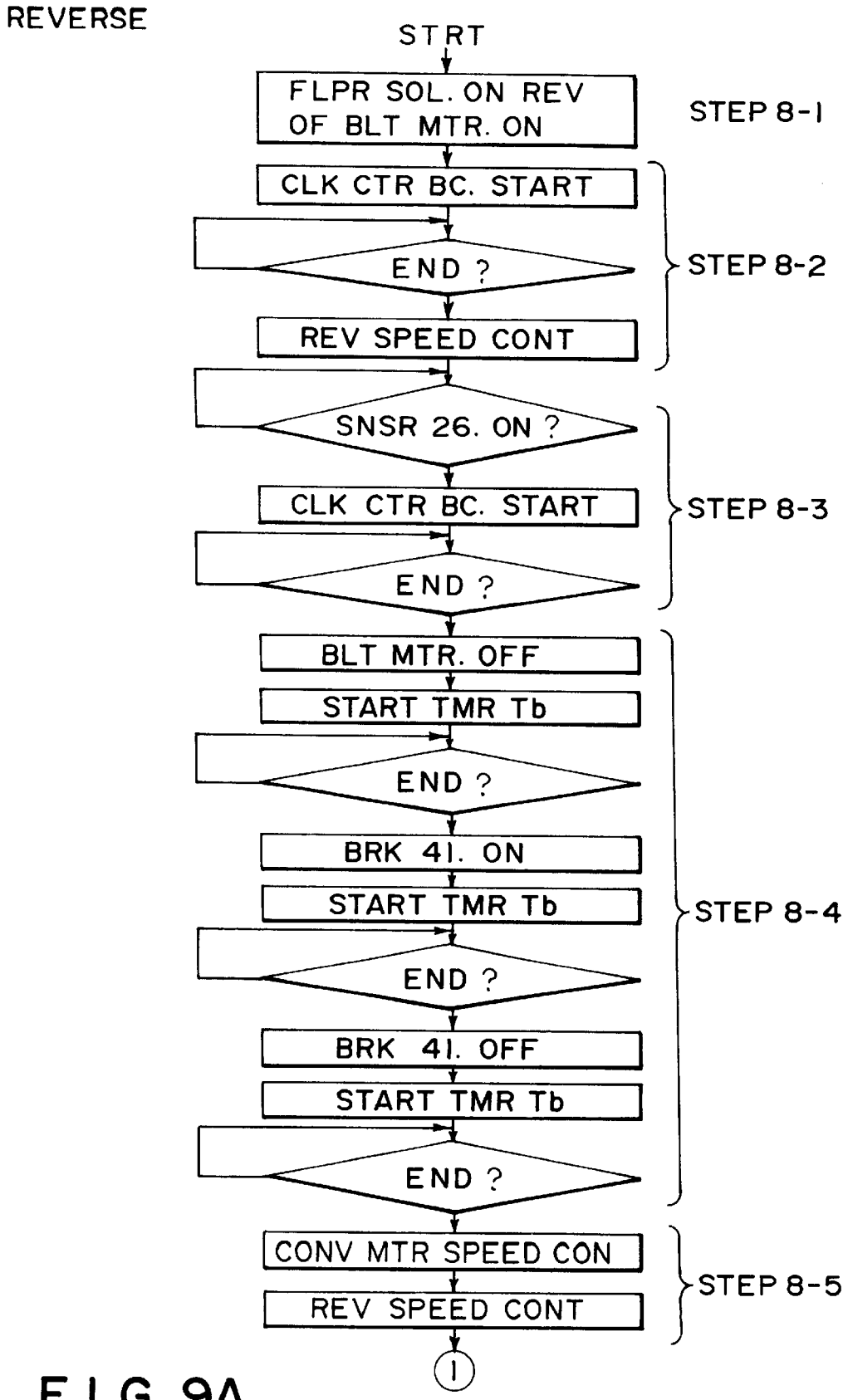
Figure 9B:
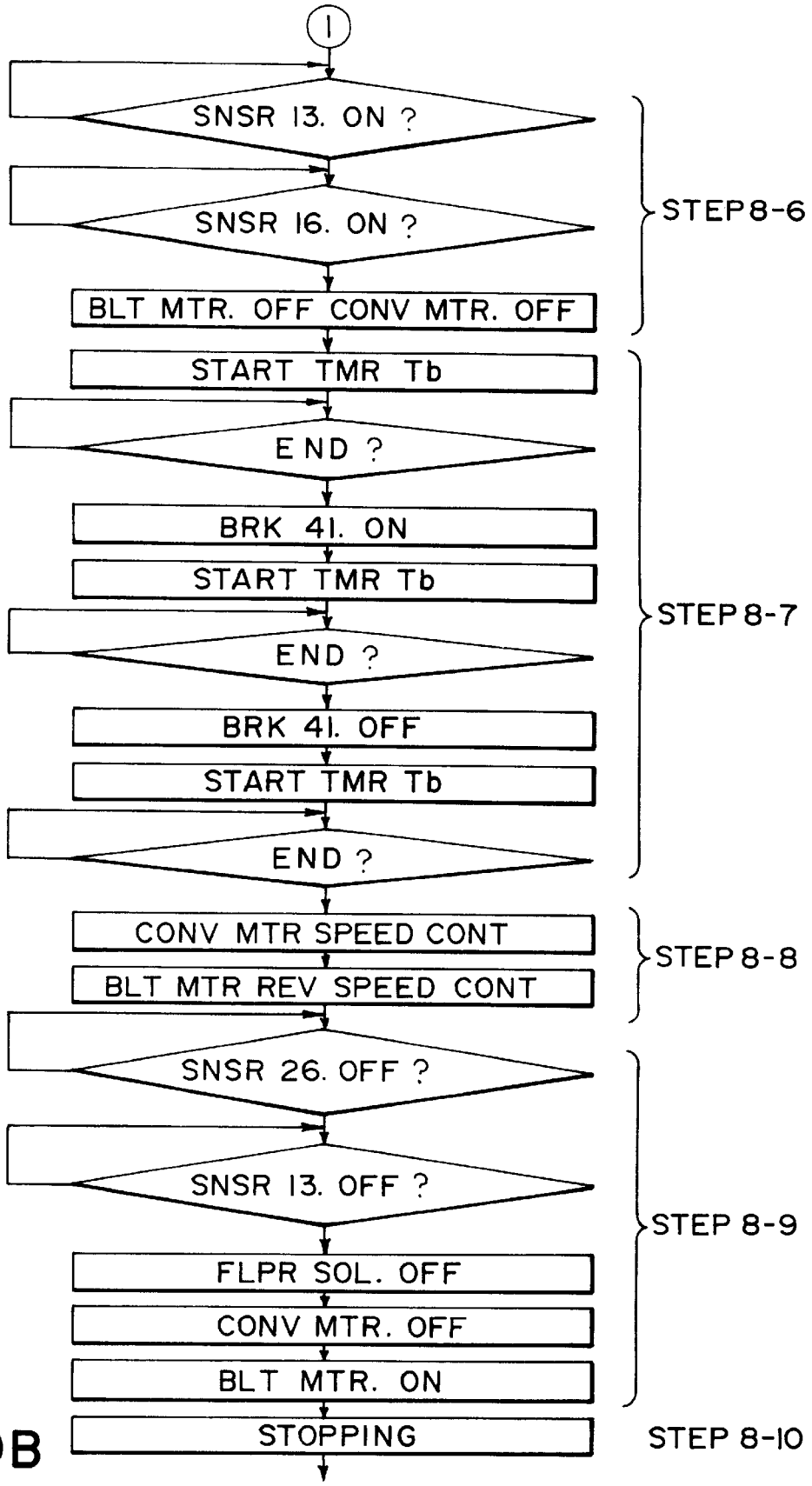

The sheet feeding process (the conveyance of the original sheet begins at the separating location) in STEP 2 in FIG. 6 is described by referring to the flow chart in FIG. 8.

In STEP 7-1, if the half-moon roller 3 is not holding the home position, the separating motor 47 is turned on. In STEP 7-2, the rotational velocity of the belt motor 45 begins to be controlled so that the linear velocity of the full width belt becomes equal to or slightly higher than the peripheral velocity of the conveying roller 15. In STEP 7-3, the sensor 12 and sensor 13 wait to be turned off, and then, when either one of them is turned off, the separating motor 47 is turned off, and also in STEP 7-3, if the sensor 13 is not turned on again till the original sheet is conveyed a predetermined distance after the sensor 13 is turned off, the trailing end of the original sheet is detected (since the trailing end of the original sheet is detected in this manner, the binding holes and the like are not recognized as the trailing end of the original sheet, even if they are near the trailing end of the original sheet).

When the trailing end is detected by the sensor 16, the velocity of the belt motor 45 is restored to the full velocity (restored to a predetermined velocity), and the original sheet stopping process in public use is carried out (to stop the original sheet at a predetermined location after a predetermined clock count), ending the sheet feeding process.

Inverting Process

Figure 9:
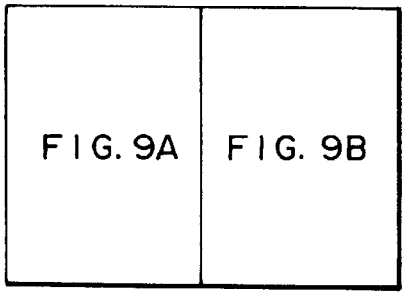
FIG. 9 includes FIGS. 9A and 9B, which show flow charts of sequential operations of the inverting process.

The inverting process in STEP 3 in FIG. 6 is described by referring to the flow chart in FIG. 9.

In STEP 8-1, the flapper solenoid 43 is turned on to open the original sheet inverting passageway, and simultaneously, the belt motor 45 is turned on to rotate in the reverse direction. After the original sheet is conveyed a predetermined distance, the belt velocity is controlled (slowed down) for the inversion (STEP 8-2). When the sensor 26 is turned on, the original sheet is conveyed another predetermined distance and its leading end is abutted against the nipping section formed between the inverting roller 27*a* and the conveying roller 15, forming a loop (STEP 8-3). The belt motor 45 is turned off, and the electromagnetic brake 41 is turned on after an elapse of a predetermined length of time, and the electromagnetic brake is turned off after an elapse of another predetermined length of time. A predetermined length time is allowed to elapse to wait for the stabilization of the loop, and meanwhile, the attitude of the original sheet is corrected (STEP 8-4). Then, the conveying motor 46 is controlled to hold a predetermined velocity, and the belt motor is turned on and simultaneously begins to be controlled so that the linear velocity of the full width belt becomes equal to or slightly lower than the peripheral velocity of the conveying roller (STEP 8-5). When the sensor 16 is turned on after the sensor 13 is turned on, the conveying motor 46 and the belt motor 45 are turned off (STEP 8-6). After an elapse of a predetermined length of time, the electromagnetic brake 41 is turned on; after an elapse of another predetermined length of time, the electromagnetic brake is turned off; after a predetermined length of time from the time the electromagnetic brake is turned off (STEP 8-7) the conveying motor 46 is turned on and begins to be controlled to keep a predetermined velocity, and also, the belt motor 45 is turned on and begins to be controlled so as to rotate in the reverse direction while keeping a predetermined velocity, so that the linear velocity of the full width belt 20 becomes equal to or slightly higher than the peripheral velocity of the conveying roller. When the sensor 26 and the sensor 13 are turned off, and the trail end of the original sheet is detected, the flapper solenoid and the conveying motor 46 are turned off, and the belt motor is turned on to rotate at the full velocity (STEP 8-9); the original sheet stopping process is carried out (STEP 8-10), ending the inverting process.

Sheet discharging process

Figure 10:
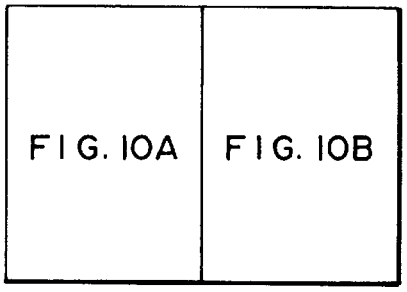
FIG. 10 includes FIGS. 10A and 10B, which show flow charts of sequential operations of the discharging process.

The sheet discharging process in STEP 5 in FIG. 6 is described by referring to the flow chart in FIG. 10.

In STEP 9-1, the belt motor 45 is turned on to rotate in the reverse direction, and the original sheet is conveyed a predetermined distance. In STEP 9-2, the reverse velocity of the belt is controlled; when the sensor 26 is turned on, the original sheet is conveyed a predetermined distance and then, the belt motor 45 is turned off; after a short time, the conveying motor 46 is turned on.

If the operating mode is not the high speed mode (if the sheet size is large, the succeeding original sheet is fed after the preceding original sheet is completely discharged), the belt motor is turned on to rotate in the reverse direction, and at the same time, its velocity is controlled so as for the linear velocity of the full width belt 20 to become equal to or slightly lower than the peripheral velocity of the conveying roller, and STEP 9-5 is followed (STEP 9-3).

If the operating mode is the high speed mode, the electromagnetic brake 41 is turned on after the conveying roller rotates a predetermined peripheral distance; after the conveying roller rotates another predetermined peripheral distance, the electromagnetic brake is turned off; the conveying roller rotates a predetermined peripheral distance (determined by the clock pulse) till the electromagnetic brake is turned off (meanwhile, the braking force is completely removed) (STEP 9-4). As the sensor 29 is turned on, and then, the sensor 26 is turned off, STEP 9-1 is followed (STEP 9-5).

If the operation mode is not the high speed mode, the belt motor is turned off; the electromagnetic brake is turned on after the conveying roller rotates a predetermined peripheral distance; the electromagnetic brake is turned off after another predetermined peripheral distance (STEP 9-5). When the sensor 29 detects the trailing end of the original sheet, the discharge velocity control (slow velocity control) of the conveying roller 46 is started (STEP 9-7), ending the sheet discharging process.

Alternative embodiment

Figure 11:
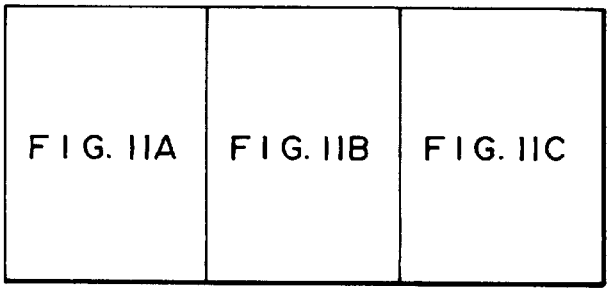
FIG. 11 includes FIGS. 11A and 11C, which show flow charts of another example of sequential operations of the separating process.

As is shown in FIG. 11, during the pre-feeding process, the motor may be stopped after a predetermined number of clock counts from the time of second input from the original sheet detection means.

Below, the main assembly of a copy machine in which the automatic document feeder in accordance with a preferred embodiment of the present invention is briefly described.

In the main assembly 100, 17 is a platen glass, 103 an illuminating lamp for illuminating the original sheet (exposure lamp), 105, 107 and 109 scanning mirrors for changing the directions of light passage for the original sheet, 111 a lens having the functions to focus and to magnify, 113 a fourth reflecting mirror (scanning mirror) for deflecting the light passage, 115 an optical system motor for driving the optical system, and 117 and 121 are sensors.

Reference numeral 131 is a photosensitive drum, 133 a main motor for driving the photosensitive drum 131, 135 a high voltage unit, 137 a blank exposure unit, 139 a developing device, 140 a developing roller, 141 a transfer charger, 143 a separation charger, and 145 is a cleaning device.

Reference numeral 151 is an upper cassette, 153 a lower cassette, 171 a hand feed inlet, 155 and 157 feeding rollers, 159 a register roller. Further, 161 is a conveyer belt for conveying the recording sheet with a transferred image toward a fixing device, 163 the fixing device for fixing the image on the conveyed recording paper by means of thermocompression bonding, 165 a roller for delivering the fixed sheet to a pedestal or a sorter 300, which will be described later, and 167 is a sensor to be used for detecting the sheet during the duplex recording.

The surface layer of the above mentioned photosensitive drum is made of a seamless photosensitive material composed of photosensitive material and conductive material. This drum 131 is rotatably supported on its axis, and is rotated in the arrow direction by a main motor 133 which is activated in response to the depression of the copying process initiation key, which will be described later. After the rotation of the drum 131 is controlled to a predetermined velocity, and the electric potential control process is completed (preliminary process), the original sheet positioned on the platen glass is illuminated by the illuminating lamp 103, which is assembled into a unit, together with the first scanning mirror 105. The reflective beam of light from the original sheet is transmitted through the first scanning mirror 105, second scanning mirror 107, third scanning mirror 109, lens 111, and fourth scanning mirror 113, and is focused on the drum 131.

The drum 131 is corona-charged by the high voltage unit 135. Then, the image (original sheet image) illuminated by the illuminating lamp 103 is slit-exposed and formed as an electrostatic image on the drum 131 by means of the Carlson system in public use.

Next, the electrostatic image on the photosensitive drum 131 is developed by the developing roller 140 of the developing device 139, whereby the image is visualized as a toner image. This toner image is transferred onto the transfer sheet by the transfer charger 141, in such a manner as will be described later.

On the other hand, the transfer sheet in the upper cassette 151 or the lower cassette 153, or the transfer sheet positioned at the hand feed inlet 171 is fed into the main assembly by the feed rollers 155 or 157, or a hand feed roller. Then, the sheet is conveyed further toward the photosensitive drum 131 by the register roller 159 having an accurate synchronizing function, whereby the leading end of the latent image is aligned with the leading end of the transfer sheet. Next, the transfer paper passes between the transfer charger 141 and the drum 131, whereby the toner image on the drum 131 is transferred onto the transfer sheet. After this transfer, the transfer sheet is separated from the drum 131 by the separating charger 143, is guided to the fixing device by the conveyer belt 161, where it is fixed by pressure and heat, and then, is discharged out of the main assembly by discharge roller 165.

The drum 131 continues to rotate even after the transfer, so that its surface is cleaned by the cleaning device comprising a cleaning roller and an elastic blade.

Reference 200 is a pedestal for accommodating temporarily the sheet discharged from the copy machine main assembly 100, while the sheet is waiting for the subsequent process. The pedestal is removable from the main assembly 100, and has a deck 201 which can store 2,000 transfer sheets, and an interim tray 203 used during a duplex copying process. A lifter 205 of the deck 201 which can store the 2,000 sheets rises in response to the amount of the transfer sheet, so that the transfer sheet remains constantly in contact with the feed roller 207.

The reference numeral 211 is a sheet discharge flapper for switching the sheet discharge passageway among the duplex recording side, multiplex recording side, and the discharge side 213 and 215 a conveying passageway for the conveyer belt, 217 an interim tray weight for holding down the transfer sheets. The transfer sheet, which is passed along the sheet discharge flapper 211 and the conveyance passageway 213 and 215, is inverted, and then, is stored in the interim tray 203 for the duplex copying process. Reference numeral 219 is a flapper for making a selection between the duplex recording passageway and the multiplex recording passageway, which is provided between the conveyance passageway 213 and 215, and guides the transfer sheet to the multiplex recording passageway 221 by pivoting upward. The reference numeral 223 is a multiplex sheet discharge sensor which detects the trailing end of the transfer sheet when the multiplex flapper 219 is driven. The reference numeral 225 is a feed roller for re-feeding the transfer sheet toward the drum 131 through the passageway 227, and 229 is a discharge roller for discharging the transfer sheet out of the apparatus.

At the time of duplex recording (duplex copying) or multiplex or superposing recording (multiplex copying), the sheet discharge flapper 211 of the main assembly 100 is pivoted upward so that the transfer sheet, which has a transferred image on one surface, is conveyed through the conveyance passageways 213 and 215 of the pedestal 200, to the interim tray 203, where it is temporarily stored. At this time, the multiplex flapper 219 is pivoted downward in the case of double side recording, and is pivoted upward in the case of the multiplex recording. This interim tray 203 can store up to 99 sheets, for example, and the transfer sheets stored in the interim tray 203 are held down by the weight 217. Then, during the subsequent operation of recording on the back side of the sheet or recording in multiplex mode, the transfer sheets stored in the interim tray 203 are guided one by one from the bottom, through the passageway 227, to the register roller 159 of the main assembly 100, by the coordination between the feed roller 225 and the weight 217.

While the invention has been described with reference to the structures disclosed herein, it is not confined to the details set forth and this application is intended to cover such modifications or changes as may come within the purposes of the improvements or the scope of the following claims.

What is claimed is:

1. An automatic document feeder provided with a pre-feed function, in which during presence of an original at a reading station, a succeeding original is fed to an entry to the reading station and kept there, comprising:

an original stacking tray for stacking originals;

separating means for separating a single original from the stacked originals on said stacking tray;

first driving means for driving said separating means;

feeding means for feeding the original separated by said separating means;

conveying means for conveying the original fed by said feeding means to said reading station;

third driving means for reciprocally driving said conveying means;

a discharge path for guiding the original discharged from the reading station by the conveying means;

discharge means for feeding the original guided by the discharge path;

second driving means for driving said feeding means and said discharge means;

first controlling means, provided with detecting means disposed downstream of said feeding means, for stopping the original adjacent an inlet of said conveying means and out of the discharge path; and second controlling means, wherein when a leading edge of a current original reaches said discharge means by reverse rotation of said conveying means, said second controlling means rotates said discharge means and said feeding means substantially simultaneously, and rotates said conveying means in a forward direction, so that a subsequent original is fed to said reading station while discharging the current original.

2. A document feeder in accordance with claim 1, wherein a sensor is provided upstream of said feeding means, and said separating means is stopped after an elapse of a predetermined length of time from the time when a leading end of the original is detected by said sensor.

3. A document feeder in accordance with claim 1, further comprising inverting means for inverting the original, which is discharged from the reading station by reverse rotation of said conveying means, and guiding the inverted original to the inlet of said conveying means through said discharge means and said feeding means.

4. A document feeder in accordance with claim 3, wherein said inverting means comprises three rollers cooperating with a common roller which also function as said feeding means and discharge means.

5. A document feeder in accordance with claim 1, wherein said separating means is equipped with an auxiliary roller, forward rotation roller, and reverse rotation belt, and separates an original from a bottom side of the set of originals;

said feeding means is equipped with a pair of rollers, and has a function as a registering means for correcting an attitude of the original by making the original sheet loop upward; and said conveying means includes a conveyer belt which is rotatable in a forward or reverse direction on a platen, which is the reading location.

6. A document feeder in accordance with claim 1, wherein the original discharged by said conveying means is discharged, through a discharge passageway, to said original stacking tray.

7. A document feeder in accordance with claim 6, wherein the discharging passageway is provided with discharging rollers, which are controlled by said driving means of the conveying means.

8. A document feeder in accordance with claim 7, wherein an inverting means includes a pair of rollers, which also functions as said feeding means, and a part of said inverting means constitutes a part of said discharge passageway.

9. An image forming apparatus including an automatic document feeder provided with a pre-feed function in which during reading of an original at a presence station, a succeeding original is fed to an entry to the reading station and kept there, comprising:

an original stacking tray for stacking originals;

separating means for separating a single original from the stacked originals on said stacking tray;

first driving means for driving said separating means;

feeding means for feeding the original separated by said separating means;

conveying means for conveying the original fed by said feeding means to said reading station;

third driving means for reciprocally driving said conveying means;

a discharge path for guiding the original discharged from the reading station by the conveying means;

discharge means for feeding the original guided by the discharge path;

second driving means for driving said feeding means and said discharge means;

first controlling means, provided with detecting means disposed downstream of said feeding means, for stopping the original adjacent an inlet of said conveying means and out of the discharge path; and second controlling means, wherein when a leading edge of a current original reaches said discharge means by reverse rotation of said conveying means, said second controlling means rotates said discharge means and said feeding means substantially simultaneously, and rotates said conveying means in a forward direction, so that a subsequent original is fed to said reading station while discharging the current original.

10. An automatic document feeder provided with a pre-feed function, in which, during presence of an original at a reading station, a succeeding original is fed to an entry to the reading station and kept there, comprising:

an original stacking tray for stacking originals;

separating means for separating a single original from the stacked originals on said stacking tray;

feeding means for feeding the original separated by said separating means;

conveying means for conveying the original fed by said feeding means to said reading station, and thereafter, for discharging the original from the reading station by reverse rotation;

a discharge path for guiding the original discharged from the reading station by the conveying means;

discharge means for feeding the original guided by the discharge path;

first controlling means, provided with detecting means disposed downstream of said feeding means, for stopping the original adjacent an inlet of said conveying means and out of the discharge path; and second controlling means wherein when a leading edge of a current original reaches said discharge means by reverse rotation of said conveying means, said second controlling means rotates said feeding means and rotates said conveying means in a forward direction, so that a subsequent original is fed to said reading station while discharging the current original.

11. A feeder according to claim 10, wherein said feeding means and said discharge means are rotated by a common motor.

12. A feeder according to claim 11, wherein said feeding means and said discharge means have a common large diameter roller.

13. An image forming apparatus including an automatic document feeder provided with a pre-feed function, in which, during presence of an original at a reading station, a succeeding original is fed to an entry to the reading station and kept there, comprising:

an original stacking tray for stacking originals;

separating means for separating a single original from the stacked originals on said stacking tray;

feeding means for feeding the original separated by said separating means;

conveying means for conveying the original fed by said feeding means to said reading station, and thereafter, for discharging the original from the reading station by reverse rotation;

a discharge path for guiding the original discharged from the reading station by the conveying means;

discharge means for feeding the original guided by the discharge path;

first controlling means, provided with detecting means disposed downstream of said feeding means, for stopping the original adjacent an inlet of said conveying means and out of the discharge path; and second controlling means, wherein when a leading edge of a current original reaches said discharge means by reverse rotation of said conveying means, said second control means rotates said feeding means and rotates said conveying means in a forward direction, so that a subsequent original is fed to said reading station while discharging the current original.

14. An automatic document feeder provided with a pre-feed function, in which during presence of an original at a reading station, a succeeding original is fed to an entry to the reading station and kept there, comprising:

an original stacking tray for stacking originals;

separating means for separating a single original from the stacked originals on said stacking tray;

first driving means for driving said separating means;

feeding means for feeding the original separated by said separating means;

second driving means for driving said feeding means;

conveying means for conveying the original fed by said feeding means to said reading station;

third driving means for reciprocally driving said conveying means;

a discharge path for guiding the original discharged from the reading station by the conveying means; and controlling means, provided with detecting means disposed downstream of said feeding means, for stopping the original adjacent an inlet of said conveying means and out of the discharge path.

15. An image forming apparatus including an automatic document feeder provided with a pre-feed function, in which, during presence of an original at a reading station, a succeeding original is fed to an entry to the reading station and kept there, comprising:

an original stacking tray for stacking originals;

separating means for separating a single original from the stacked originals on said stacking tray;

first driving means for driving said separating means;

feeding means for feeding the original separated by said separating means;

second driving means for driving said feeding means;

conveying means for conveying the original fed by said feeding means to said reading station;

third driving means for reciprocally driving said conveying means;

a discharge path for guiding the original discharged from the reading station by the conveying means; and controlling means, provided with detecting means disposed downstream of said feeding means, for stopping the original adjacent an inlet of said conveying means and out of the discharge path.

16. An automatic document feeder provided with a pre-feed function, in which during presence of an original at a reading station, a succeeding original is supplied to a keeping position between a supply station and the reading station and kept there, comprising:

conveying means for conveying the original to said reading station, and thereafter, for discharging the original from the reading station by reverse rotation;

feeding means, disposed upstream of said conveying means, for feeding the original supplied thereto directly to said conveying means;

an interim guide having an upper surface defining an inlet to said conveying means;

a discharge path for guiding the original discharged from the reading station by said conveying means to discharge the original below the inlet of said conveying means;

discharge means for feeding the original guided by the discharge path;

controlling means, provided with detecting means disposed downstream of said feeding means, for stopping the original adjacent the inlet of said conveying means and out of the discharge path; and wherein when a leading edge of a current original reaches said discharge means by reverse rotation of said conveying means, said controlling means rotates said feeding means and rotates said conveying means in a forward direction, so that a succeeding original is fed to said reading station while discharging the current original.

17. An image forming apparatus including an automatic document feeder provided with a pre-feed function in which during presence of an original at a reading station, a succeeding original is supplied to a keeping position between a supply station and the reading station and kept there, comprising:

conveying means for conveying the original to said reading station, and thereafter, for discharging the original from the reading station by reverse rotation;

feeding means, disposed upstream of said conveying means, for feeding the original supplied thereto directly to said conveying means;

an interim guide having an upper surface defining an inlet to said conveying means;

a discharge path for guiding the original discharge from the reading station by said conveying means to discharge the original below the inlet of said conveying means;

discharge means for feeding the original guided by the discharge path;

controlling means, provided with detecting means disposed downstream of said feeding means, for stopping the original adjacent the inlet of said conveying means and out of the discharge path; and wherein when a leading edge of a current original reaches said discharge means by reverse rotation of said conveying means, said controlling means rotates said means and rotates said conveying means in a forward direction, so that a succeeding original is fed to said reading station while discharging the current original.

18. A feeder according to claim 14, further comprising second controlling means for stopping said conveying means a predetermined period after a trailing edge of the original passes by said detecting means and for correctly positioning the original in said reading station.

19. An apparatus according to claim 15, further comprising second controlling means for stopping said conveying means a predetermined period after a trailing edge of the original passes by said detecting means and for correctly positioning the original in said reading station.

20. A feeder according to claim 1 or 10, further comprising second controlling means for stopping said conveying means a predetermined period after a trailing edge of the original passes by said detecting means and for correctly positioning the original in said reading station.

21. An apparatus according to claim 9 or 13, further comprising a third controlling means for stopping said conveying means a predetermined period after a trailing edge of the original passes by said detecting means and for correctly positioning the original in said reading station.

22. An apparatus according to claim 16, further comprising an original stacking tray for stacking originals, and separating means, disposed upstream of said feeding means, for separating a single original from the stacked originals on said stacking tray and for supplying the single original to the feeding means.

23. An apparatus according to claim 17, further comprising an original stacking tray for stacking originals, and separating means, disposed upstream of said feeding means, for separating a single original from the stacked originals on said stacking tray and for supplying the single original to the feeding means.

24. A feeder according to claim 16, further comprising second controlling means for stopping said conveying means a predetermined period after a trailing edge of the original passes by said detecting means and for correctly positioning the original in said reading station.

25. An apparatus according to claim 17, further comprising a second controlling means for stopping said conveying means a predetermined period after a trailing edge of the original passes by said detecting means and for correctly positioning the original in said reading station.

* * * * *

UNITED STATES PATENT AND TRADEMARK OFFICE

CERTIFICATE OF CORRECTION

PATENT NO. : 5,833,227

DATED : November 10, 1998

INVENTOR(S) : SATOSHI CHOHO, ET AL.

It is certified that error appears in the above-identified patent and that said Letters Patent is hereby corrected as shown below:

COVER PAGE [56] RC,
Foreign Patent Documents, "3061239 3/1991 Japan" should read --3-61239 3/1991 Japan--.

COVER PAGE [57] ABSTRACT,
Line 5, "keep it" should read --kept--.

COLUMN 4,
Line 31, "then,-is" should read --then, is--.

COLUMN 8,
Line 11, "length" should read --length of--.

COLUMN 11,
Line 53, "function" should read --functions--.

COLUMN 13,
Line 42, "control" should read --controlling--.

COLUMN 15,
Line 3, "discharge" should read --discharged--; and
Line 16, "means" (first occurrence) should read --feeding means--.

UNITED STATES PATENT AND TRADEMARK OFFICE

CERTIFICATE OF CORRECTION

PATENT NO. : 5,833,227

DATED : November 10, 1998

INVENTOR(S) : SATOSHI CHOHO, ET AL.

Figure 7A:
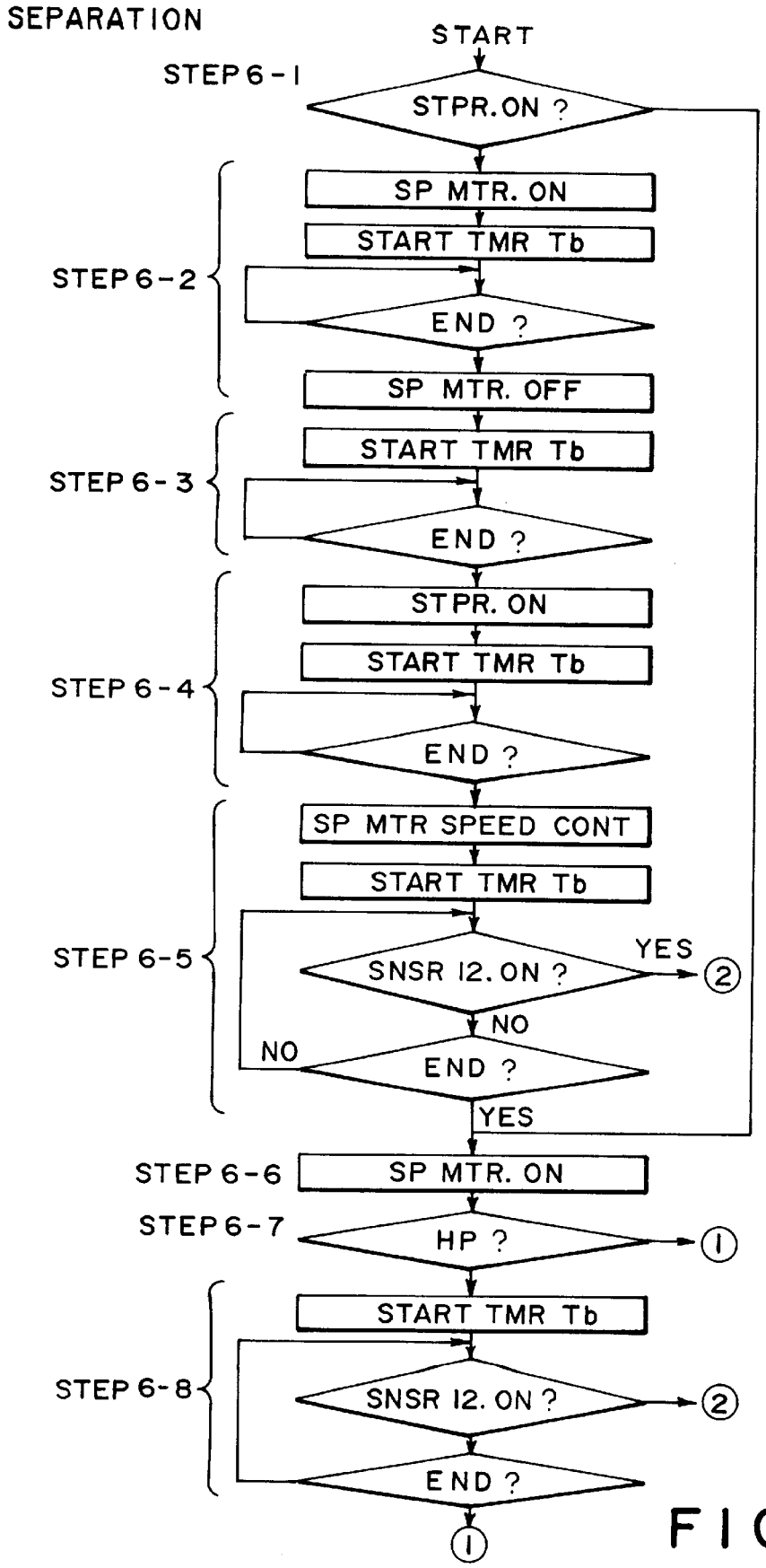
Figure 7B:
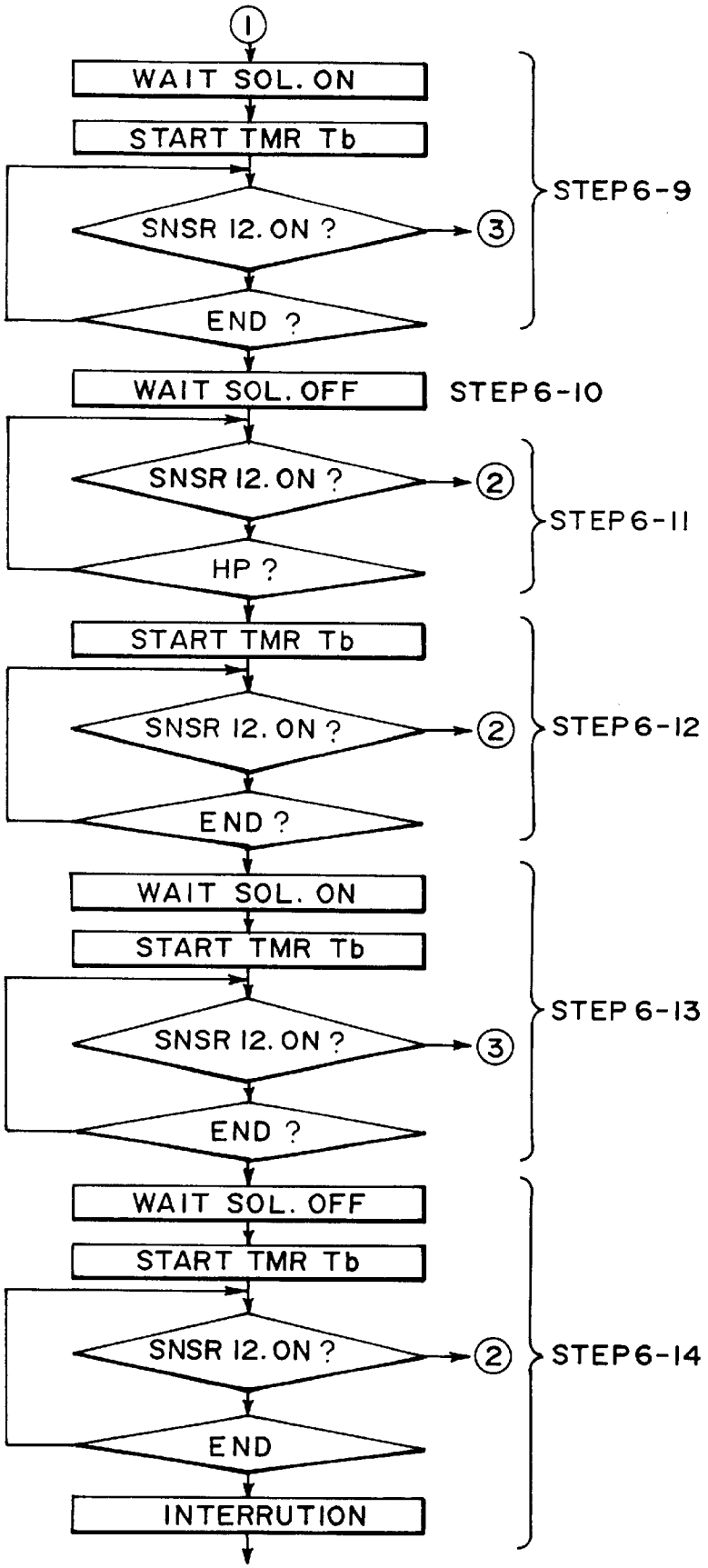
Figure 7C:
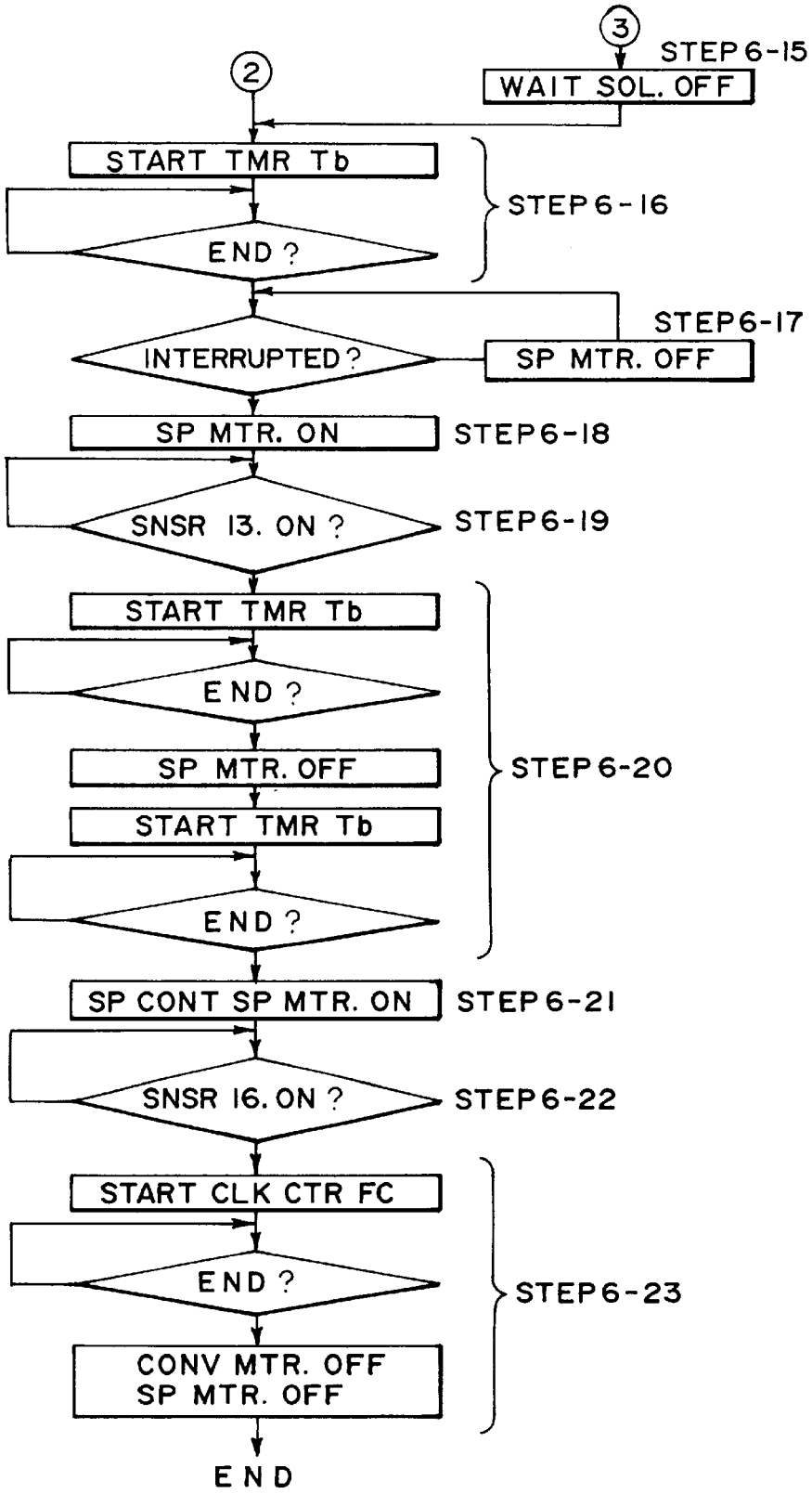

It is certified that error appears in the above-identified patent and that said Letters Patent is hereby corrected as shown below:

FIGURE 7B,
"INTERRUTION" should read --INTERRUPTION--.

Figure 10A:
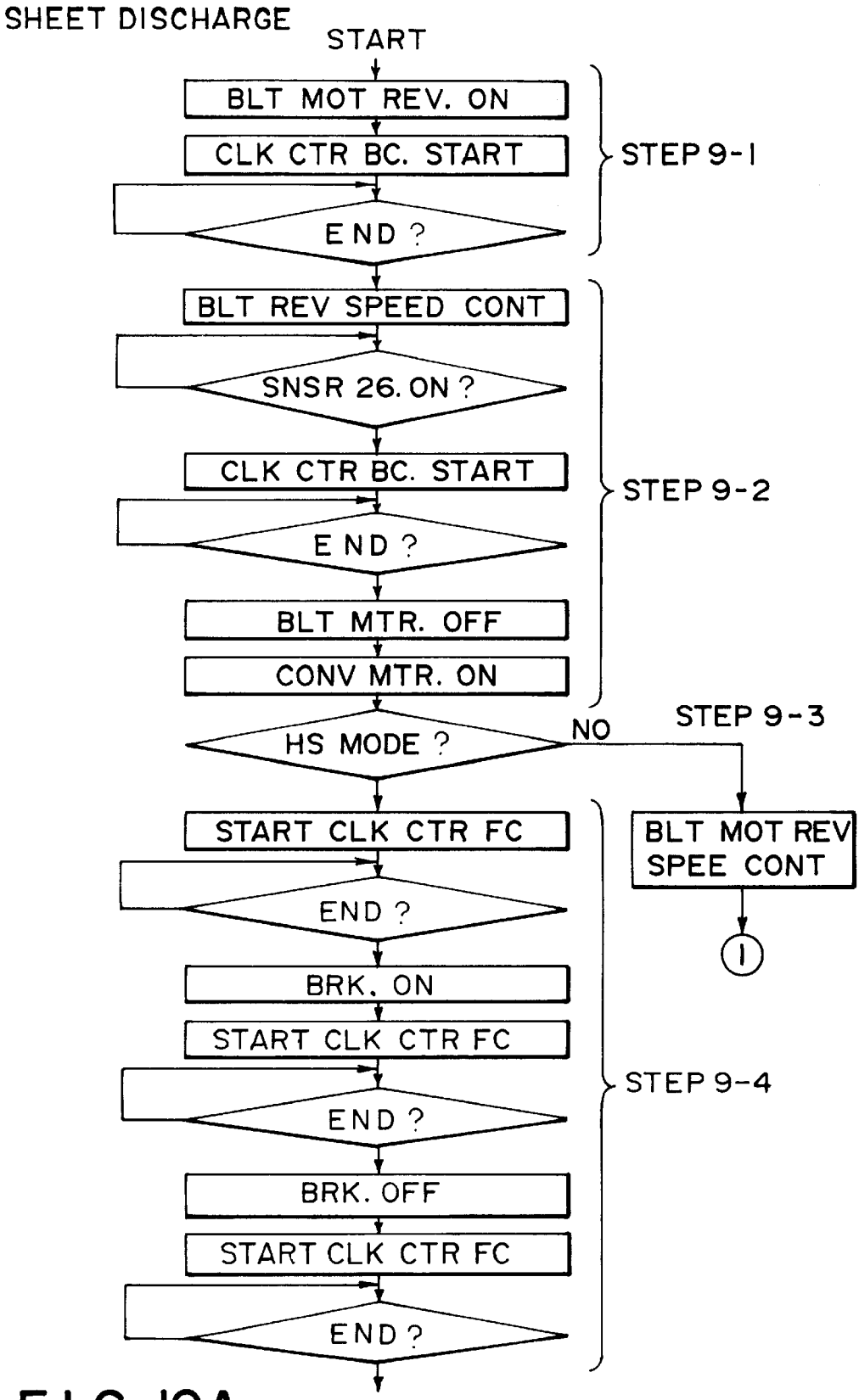
Figure 10B:
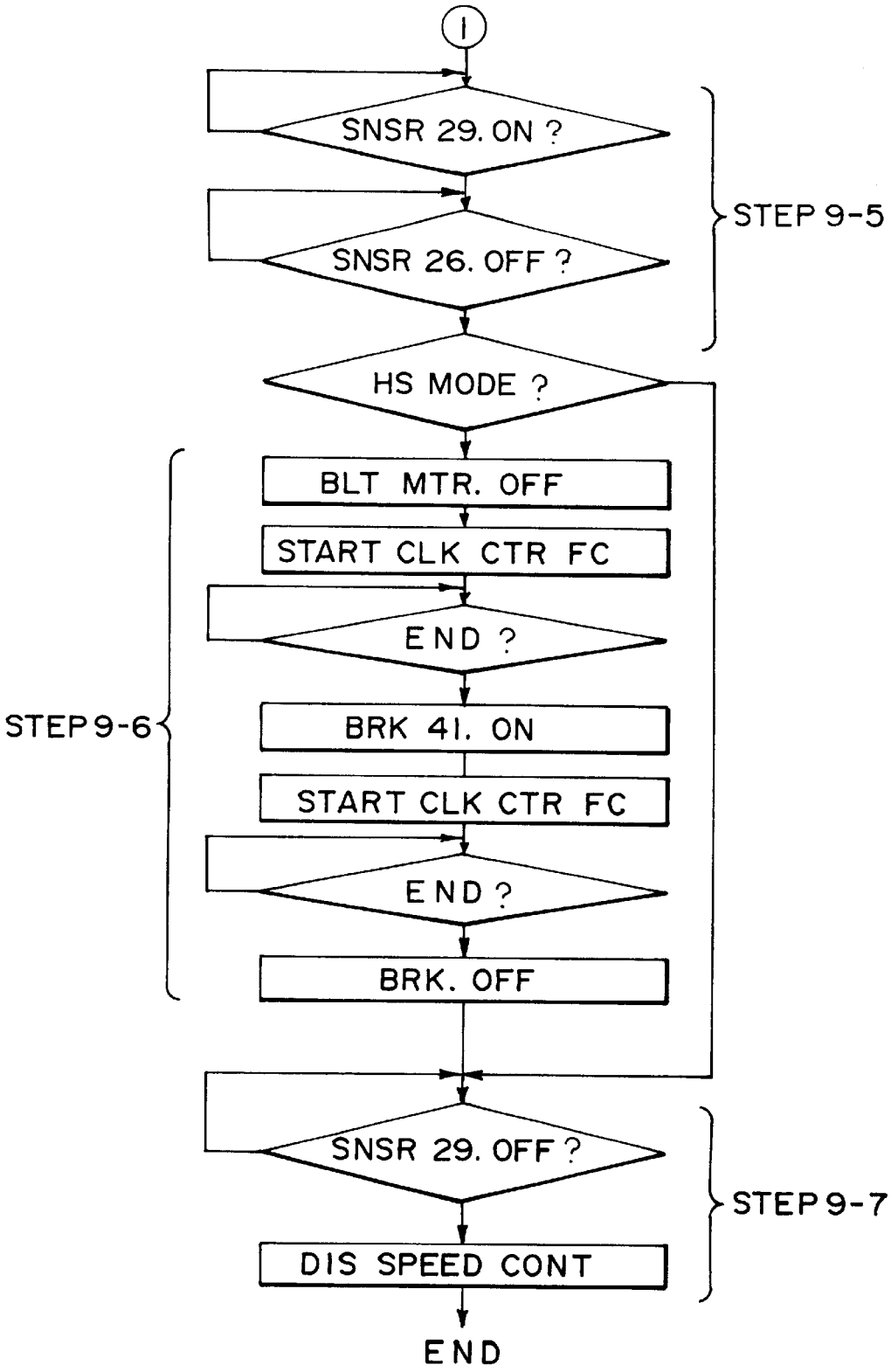
Figure 11A:
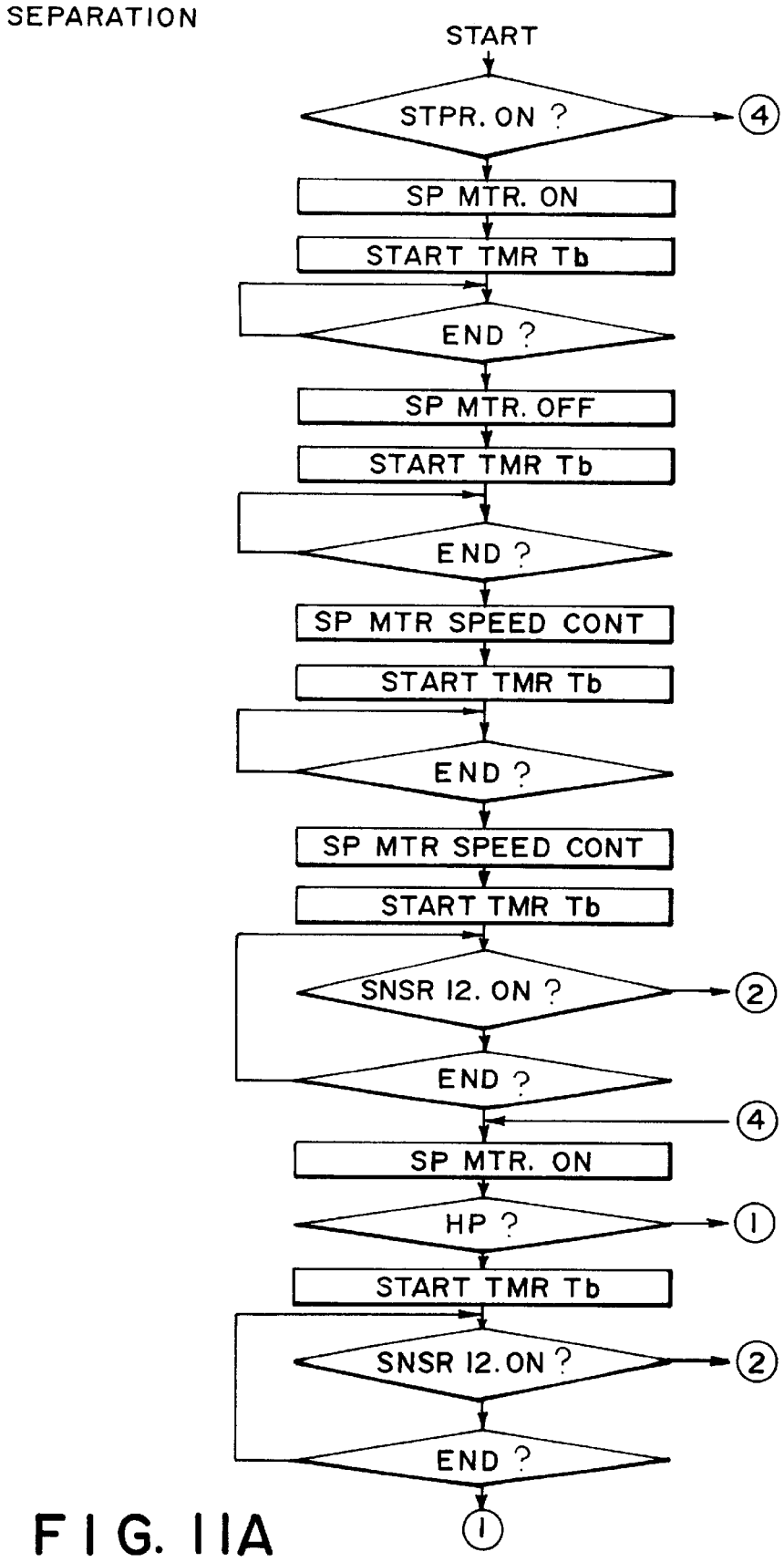
Figure 11B:
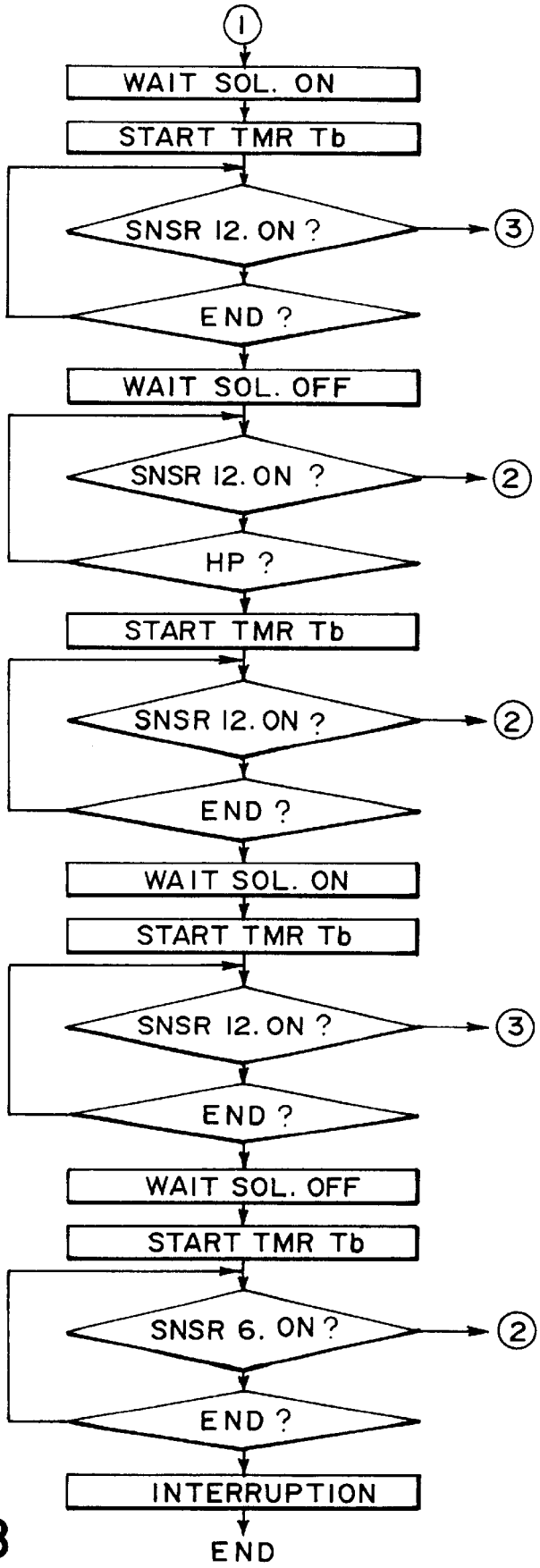
Figure 11C:
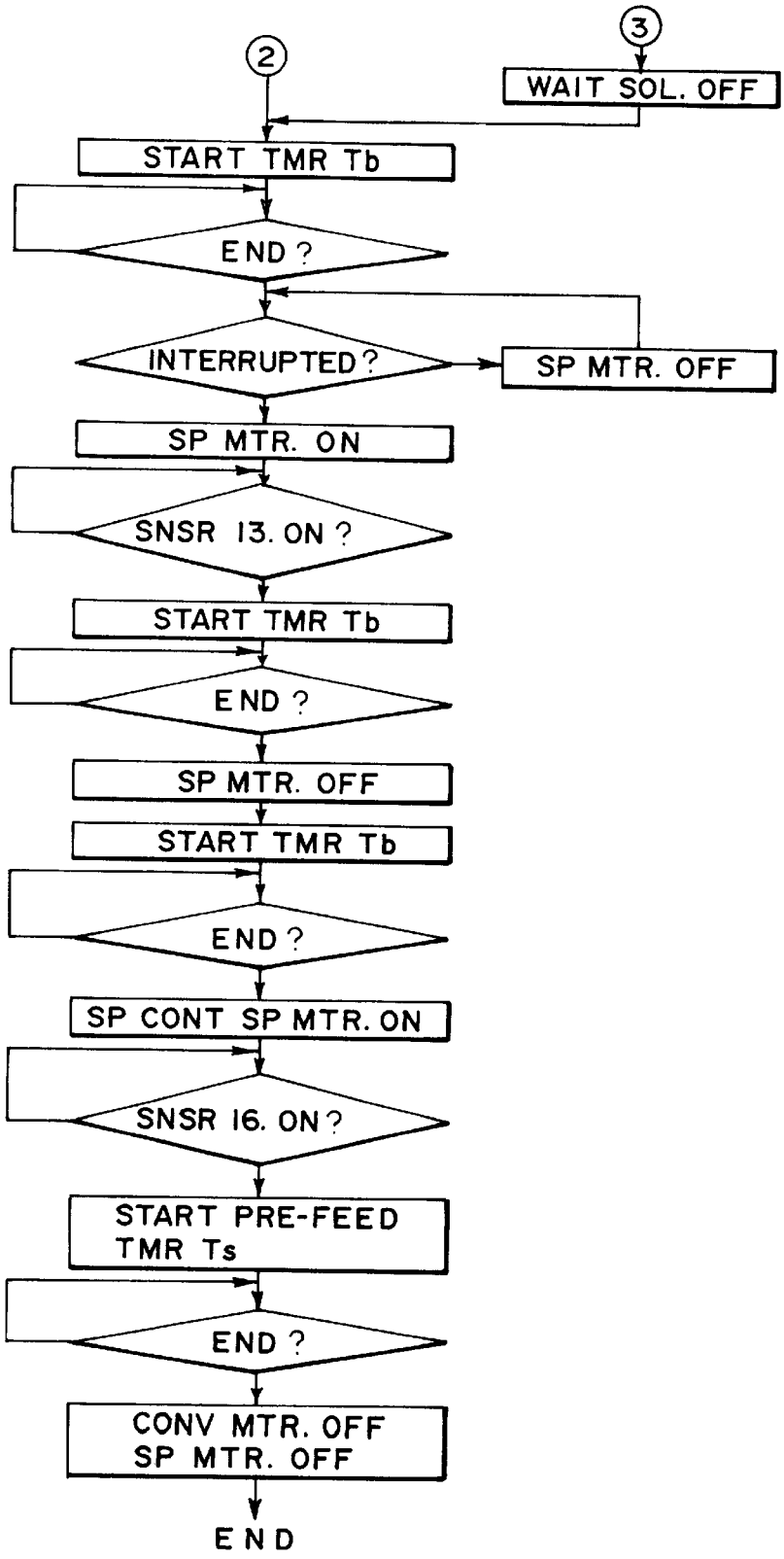
Figure 12:
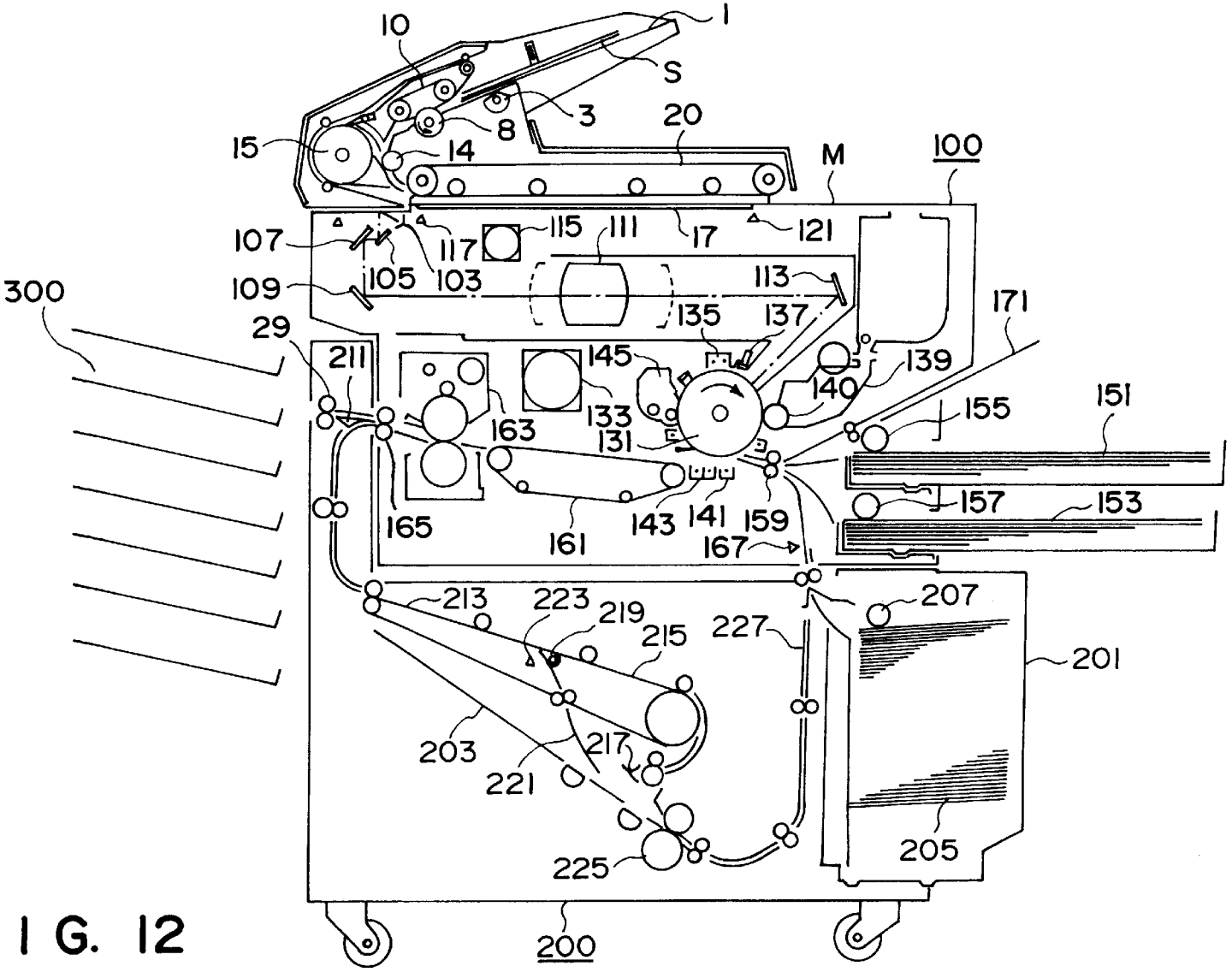
FIG. 12 is a front view showing the general structure of a copying machine.

FIGURE 10A,
SPEE" should read --SPEED--.

Signed and Sealed this

Thirteenth Day of July, 1999

*Attest:*

Q. TODD DICKINSON

*Attesting Officer*

*Acting Commissioner of Patents and Trademarks*